United States Patent [19]

Ushio et al.

[11] 3,938,303

[45] Feb. 17, 1976

[54] COIN PACKAGING APPARATUS

[75] Inventors: Masatoshi Ushio; Kazuto Asami; Matono Hirokuni, all of Himeji, Japan

[73] Assignee: Glory Kogyo Kabushiki Kaisha, Himeji, Japan

[22] Filed: May 28, 1974

[21] Appl. No.: 474,150

[30] Foreign Application Priority Data

May 25, 1973 Japan ..... 48-58952
June 8, 1973 Japan ..... 48-64973

[52] U.S. Cl. ..... 53/212
[51] Int. Cl.[2] ..... B65B 11/04
[58] Field of Search ..... 53/211, 212

[56] References Cited

UNITED STATES PATENTS

| | | | |
|---|---|---|---|
| 1,118,097 | 11/1914 | Batdorf | 53/212 X |
| 2,709,880 | 6/1955 | Jorgensen | 53/212 X |
| 2,855,739 | 10/1958 | Schoenewolf | 53/212 |
| 3,037,336 | 6/1962 | Hoffmann | 53/212 |
| 3,350,835 | 11/1967 | Becker | 53/212 X |
| 3,775,940 | 12/1973 | Hatanaka | 53/212 |
| 3,821,917 | 7/1974 | Hatanaka | 53/212 X |

*Primary Examiner*—Travis S. McGehee
*Assistant Examiner*—John Sipos
*Attorney, Agent, or Firm*—Wenderoth, Lind & Ponack

[57] ABSTRACT

For packaging a preselected number of coins of the same denomination in the form of a neat stack, there is provided apparatus which broadly includes an infeed mechanism, coin stacking mechanism, coin wrapping mechanism, coin guide mechanism, wrapper feed mechanism, and adjusting mechanism. Each preselected number of coins of the same denomination to be enclosed in a single package is fed from the infeed mechanism into a stacking cylinder of the coin stacking mechanism, where the coins are rearranged into a neat stack. The coin guide mechanism includes a guide rod movable up and down for transporting the stack of coins from within the stacking cylinder down to a prescribed position between a plurality of wrapping rolls of the coin wrapping mechanism. A strip of wrapper is then delivered from the wrapper feed mechanism to the coin wrapping mechanism and is wound around the circumference of the stack of coins as the same is caused frictionally to rotate in circumferential contact with the wrapping rolls. The loose lateral edges of the wrapper strip are succeedingly fold crimped over the top and bottom ends of the coin stack by a pair of retractable crimping hooks. Upon manual operation of a knob to select the denomination of coins to be packaged, the various working parts of the apparatus are automatically adjusted to the diameter and thickness of the coins of the selected denomination.

4 Claims, 46 Drawing Figures

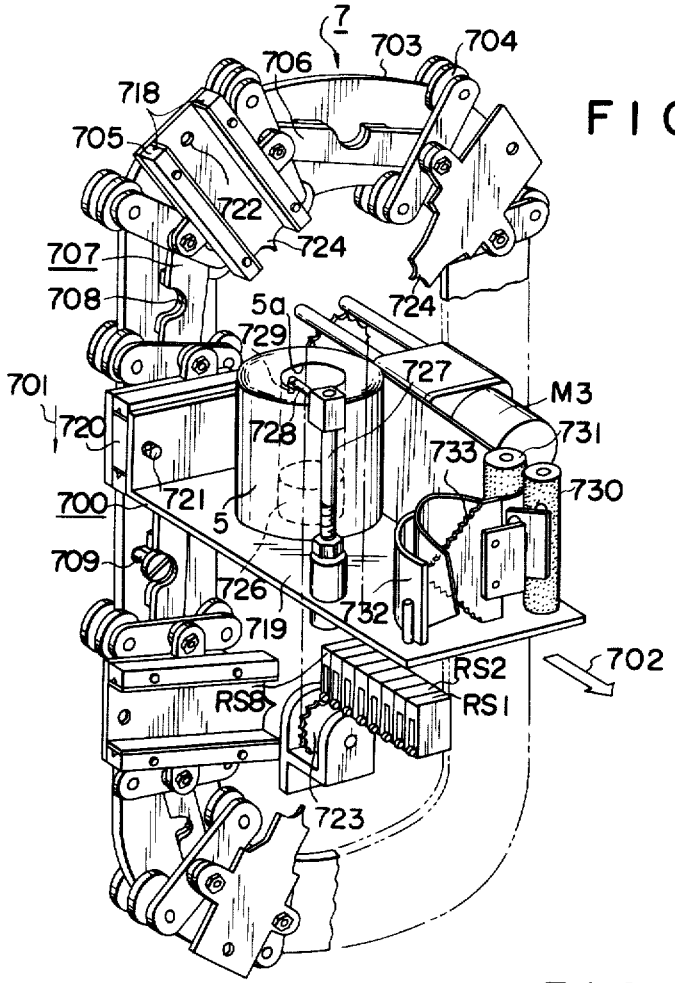
FIG. 16
FIG. 17
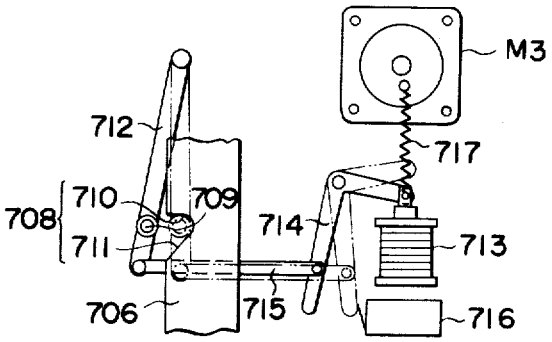

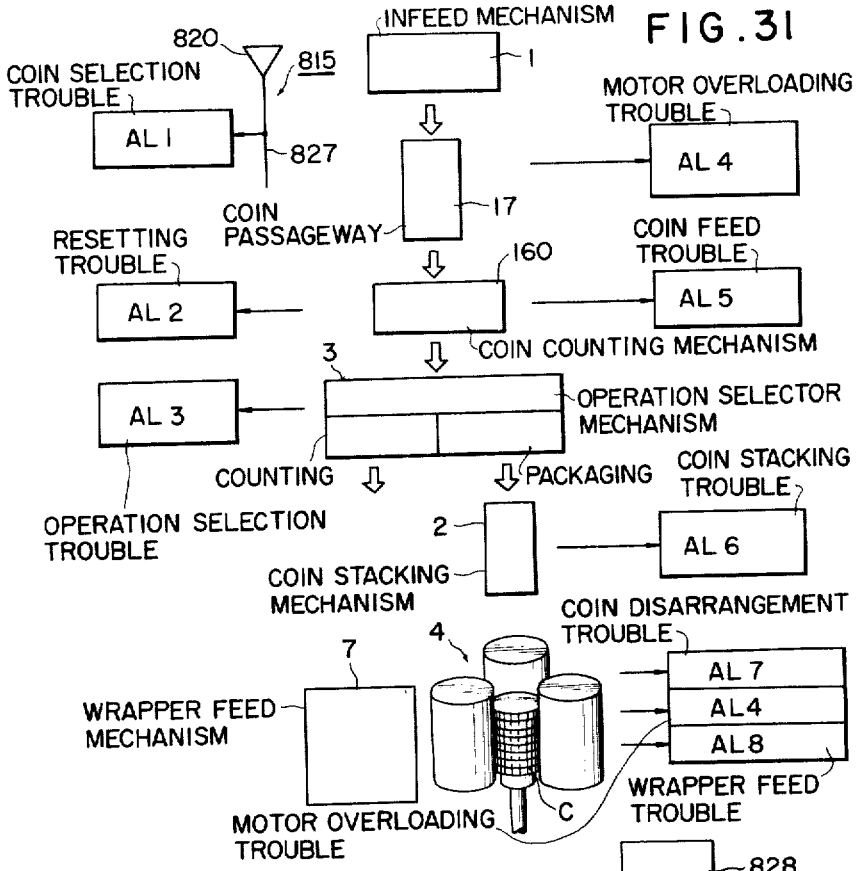
FIG. 31
INFEED MECHANISM
1
820
815
COIN SELECTION TROUBLE
AL 1
827
MOTOR OVERLOADING TROUBLE
AL 4
17
COIN PASSAGEWAY
RESETTING TROUBLE
AL 2
160
COIN FEED TROUBLE
AL 5
COIN COUNTING MECHANISM
3
AL 3
OPERATION SELECTOR MECHANISM
COUNTING
PACKAGING
COIN STACKING TROUBLE
OPERATION SELECTION TROUBLE
2
AL 6
COIN STACKING MECHANISM
COIN DISARRANGEMENT TROUBLE
4
7
AL 7
AL4
AL8
WRAPPER FEED MECHANISM
WRAPPER FEED TROUBLE
C
MOTOR OVERLOADING TROUBLE

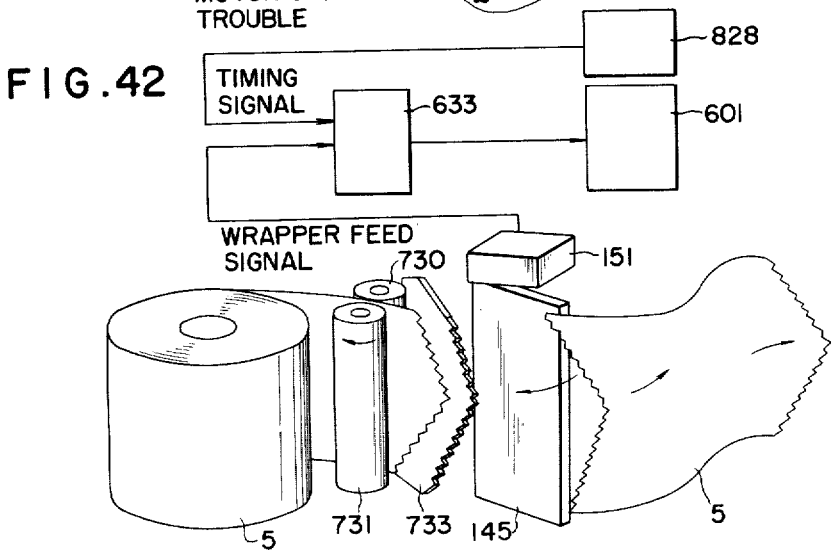
FIG. 42
828
TIMING SIGNAL
633
601
WRAPPER FEED SIGNAL
730
151
5
731
733
145
5

COIN PACKAGING APPARATUS

BACKGROUND OF THE INVENTION

This invention relates to apparatus for packaging a preselected number of coins of any of several specified denominations in the form of a neat stack. More specifically, the invention deals with coin packaging apparatus of the type comprising a stacking cylinder for arranging each preselected number of coins of the same diameter or denomination into a neat stack, and a plurality of rotatable wrapping rolls arranged annularly in parallel spaced relationship to each other. Each time the stack of coins is carried by a coin guide mechanism to a prescribed position between the wrapping rolls, some or all of these wrapping rolls move into circumferential contact with the stack of coins thereby frictionally imparting rotation thereto to permit a strip of wrapper to be wound around its circumference. The lateral edges of the strip of wrapper, still projecting beyond the top and bottom ends of the stack of coins, are then fold crimped by a pair of crimping hooks for complete packaging of the coins.

The coin packaging apparatus of the type now under consideration is usually required to handle coins of several different denominations. Since coins of different denominations differ in diameter and thickness, the various working parts of the coin packaging apparatus must be readjusted each time the apparatus is required to package coins of a different denomination. Convetionally, such readjustment has been performed manually, as by replacing some part of the apparatus with another or by shifting the position of one part relative to another. It will be apparent that such manual readjustment is highly troublesome and time-consuming, impairing in particular the utility of the coin packaging apparatus designed to handle coins of widely different diameter or thickness.

There is, for example, coin packaging apparatus incorporating a rotary disc in its infeed mechanism, such that the coins a batch of coins loaded on the rotary disc are thereby centrifugally sent out one by one into a passageway leading to the next processing stage. It the rotary disc rotates at a constant speed irrespective of the denomination of the coins, the number of coins fed out therefrom per unit length of time will change depending upon the diameter of the coins, so that the apparatus will produce packages containing different numbers of coins. Furthermore, if coins of widely different diameters are fed out by the rotary disc revolving at a constant speed, it is highly likely that the coins will clog the succeeding coin stacking mechanism or will be irregularly stacked up therein.

Another problem accompanying the prior art coin packaging apparatus concerns its coin wrapping mechanism which includes a plurality of, usually three, wrapping rolls arranged vertically in substantially annular configuration, with equal spacings from one to the next. As a stack of coins of some selected denomination is carried by a movable guide rod from the stacking cylinder of the coin stacking mechanism down to a specified position between the wrapping rolls, all but one of the wrapping rolls are displaced horizontally toward the one stationary wrapping roll, thereby tightly holding the stack of coins therebetween. It will accordingly be seen that the central axis between wrapping rolls is not aligned with the axis of the stacking cylinder or with the axis of the guide rod, especially where coins of considerably different diameters must be handled by one and the same apparatus. As a consequence, the prior art coin packaging apparatus has an inherent drawback in that the stack of coins may become disarranged between the wrapping rolls before the displaceable wrapping rolls move into proper circumferential contact therewith from their inoperative positions.

Further in connection with the coin packaging apparatus of the type described, the relative positions of the pair of crimping hooks need no readjustment if the number of coins to be enclosed in each package is unvaried regardless of their denomination, even though there may be some difference in thickness between the coins of various denominations. However, if the number of coins to be enveloped in each package is made to differ according to their denomination, then the relative positions of the crimping hooks in the prior art apparatus need preliminary readjustment for the coins of each denomination to be packaged. The coins will not be packaged properly in the event the operator fails to perform this preliminary manual readjustment.

A further problem associated with the prior art coin packaging apparatus stems from the fact that the revolving speed of the wrapping rolls in unvaried regardless of the diameter of the coins being packaged. Since the revolving speed of the stack of coins in frictional circumferential contact with the wrapping rolls rotating at a constant speed varies significantly depending upon their diameter, the strip of wrapper cannot always be wound properly around the circumference of the coin stack. It is even possible that the coins will become disarranged during their rotation by the wrapping rolls.

SUMMARY OF THE INVENTION

In view of the listed problems encountered in the prior art, it is an object of this invention to provide a novel and improved coin packaging apparatus the various working parts of which are automatically adjusted in accordance with the diameter and/or thickness of coins to be handled, so that coins of various denominations can be packaged efficiently without the need for any preliminary manual readjustment.

Another object of the invention is to provide coin packaging apparatus wherein, when a coin selecting element such as a knob is manually manipulated to select the denomination of coins to be packaged, the various working parts of the apparatus are automatically adjusted altogether in accordance with the diameter and/or thickness of the coins of the thus-selected denomination.

A further object of the invention is to provide coin packaging apparatus wherein the means for automatic adjustment of the various working parts of the apparatus need no exclusive drive source, being actuated by a drive source which powers the other working parts of the apparatus.

A further object of the invention is to provide coin packaging apparatus wherein, when the denomination of coins to be packaged is selected as aforesaid, the number of the coins to be enclosed in each package can also be automatically determined, whereby the various working parts of the apparatus are adjusted not only in accordance with the diameter and/or thickness of the coins but also with the number of coins to be enclosed in each package.

According to one aspect of the invention, the stacking cylinder, the wrapping rolls and the guide rod are arranged in a radially symmetrical manner with respect to the axis extending vertically therethrough, so that the stack of coins can be supported at its axial point by the guide rod while being transported from the stacking cylinder down to the central position between the wrapping rolls or while being rotated in frictional contact with the wrapping rolls. Supported in this manner, the stack of coins will not collapse off balance on its way from the stacking cylinder down to the wrapping rolls. It is also possible to wind a strip of wrapper correctly around the circumference of the stack of coins of whatever diameter as the wrapping rolls will unfailingly come into proper circumferential contact therewith.

According to another aspect of the invention, the intermediate and least spaced-apart positions of the wrapping rolls are adjusted to the diameters of coins of various denominations to be handled by the apparatus, in such a manner that the wrapping rolls are required to travel an unvarying minimum distance from their intermediate to least spaced-apart positions no matter which denomination of coins have been transported to the prescribed position therebetween. Since the length of time required for the wrapping rolls to shift from their intermediate to least spaced-apart positions is the same regardness of the diameter of the coins, the coin wrapping mechanism operates in exact timed relationship to the other mechanisms of the apparatus for all the denominations of coins to be packaged. Furthermore, the intermediate and least spaced-apart positions of the wrapping rolls are variously determined by manually actuable cam means with no pressure exerted on the wrapping rolls themselves, while their most spaced-apart positions are held unvaried by another cam means, so that the intermediate and least spaced-apart positions of the wrapping rolls are easily adjustable with minimum exertion of manual effort. It is also noteworthy that by thus adjusting the least spaced-apart positions of the wrapping rolls, the stack of coins of any diameter can be supported under equally appropriate pressure between the wrapping rolls. This fact further results in an extended life of the wrapping rolls through minimization of their frictional wear.

The features which are believed to be novel and characteristic of this invention are set forth with particularity in the appended claims. The invention itself, however, both as to its organization and mode of operation, together with the further objects and advantages thereof, will become more apparent and understandable from the following description of preferred embodiments when read in connection with the accompanying drawings wherein like reference characters denote like parts throughout the several views.

BRIEF DESCRIPTION OF THE DRAWINGS

FIG. 16 is a perspective view showing a wrapper feed mechanism in the apparatus of FIG. 1;

FIG. 17 is a fragmentary side elevational view for explaining the means for locking in position a wrapper magazine transport mechanism in the wrapper feed mechanism of FIG. 16;

FIG. 31 is a diagram for explaining the general organization of an alarm mechanism for use in the coin packaging apparatus according to the invention;

FIG. 42 is a schematic electrical diagram showing means for detecting Wrapper Feed Trouble.

DETAILED DESCRIPTION

Figure 1:
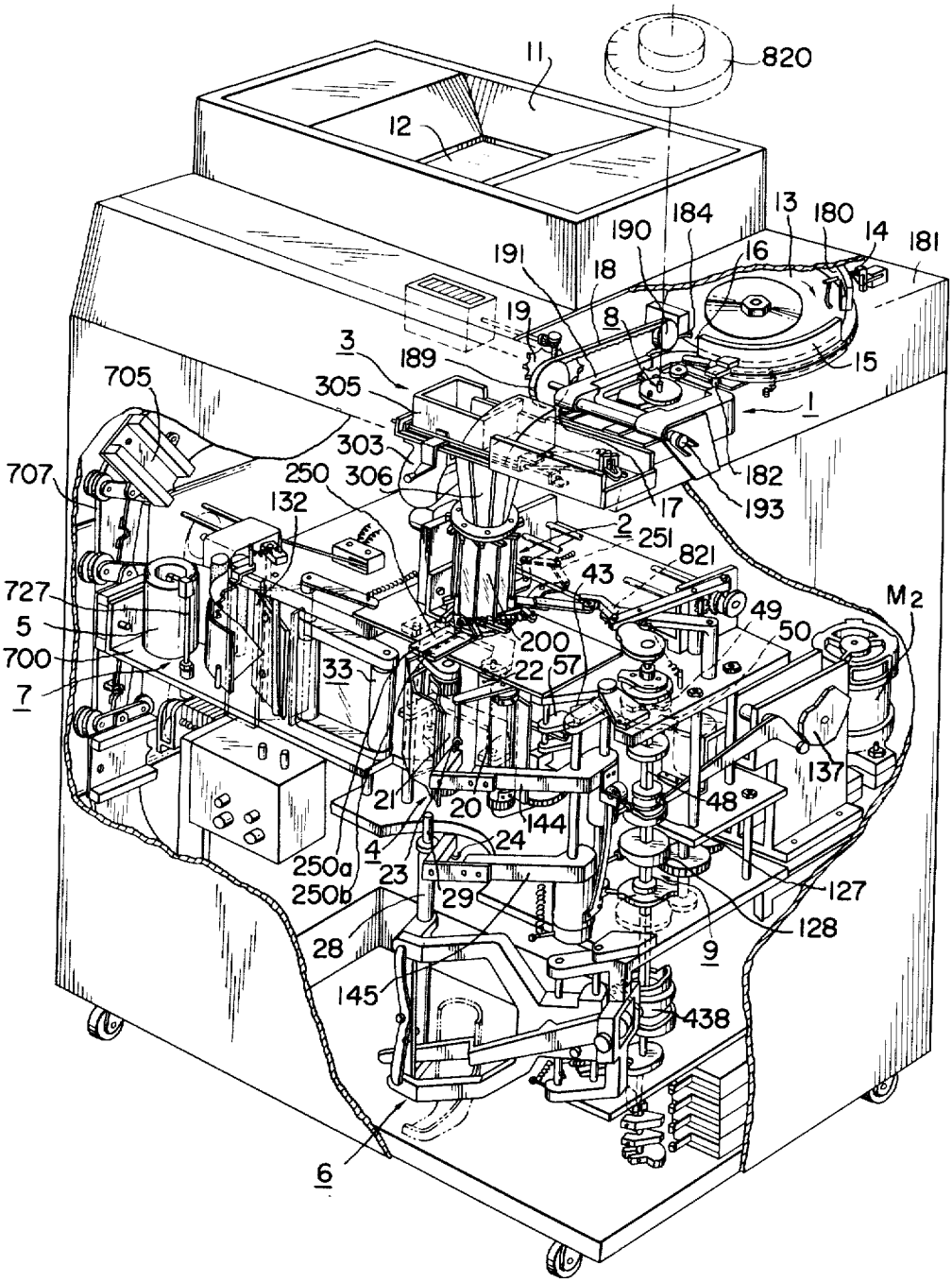
FIG. 1 is a perspective view of a coin packaging apparatus constructed in accordance with the concepts of this invention, the casing of the apparatus being shown partly broken away to illustrate inner details.

The general organization of the coin packaging apparatus according to this invention will be apparent from FIG. 1, being comprised essentially of: an infeed mechanism 1 from which each prescribed number of coins of the same denomination to be packaged is fed to the succeeding processing stage in the form of a neat row; a coin stacking mechanism 2 for stacking each batch of coins fed from the infeed mechanism 1; an operation selector mechanism 3 located between the infeed mechanism 1 and the coin stacking mechanism 2 for selectively switching the apparatus between coin packaging and counting operations; a coin wrapping mechanism 4 where each stack of coins fed from the coin stacking mechanism 2 is wound with a wrapper, and where the lateral edges of the wrapper are fold-crimped over the top and bottom ends, respectively, of the stack of coins; a coin guide mechanism 6 for directing each stack of coins from the coin stacking mechanism 2 down to the coin wrapping mechanism 4; a wrapper feed mechanism 7 for feeding a wrapper to the coin wrapping mechanism 4; a control mechanism 8 for controlling the operations of the foregoing mechanism in accordance with the diameter and thickness of each of the coins to be packaged; and a drive mechanism 9 for driving the listed mechanisms.

INFEED MECHANISM

As will be seen from FIGS. 1 and 2, the infeed mechanism 1 includes a hopper 11 having an endless moving belt 12 whereby coins assumed to be of the same denomination are loaded onto a rotary disc 13 in a quantity as regulated by a sensing mechanism 14 later described in more detail. The rotary disc 13 is provided with an arcuate wall member 15 arranged along its circumference in a manner, such that the coins overlying others on the rotary disc are removed from the underlying coins as the disc rotates.

Hence, with the rotation of the disc 13, the coins are centrifugally sent out one by one into a linear passageway 17 of adjustable width extending outwardly therefrom. Coins having a diameter greter than that of the coins of preselected denomination, if any, are prevented from entering the passageway 17 by means of a gate 16 of adjustable width provided at the entrance end of the passageway. On the other hand, coins with a smaller diameter or damaged coins can be removed by suitable means provided in the passageway 17.

The successive coins which have been fed into the passageway 17 as aforesaid are frictionally caused to advance toward its exit end by an endless moving belt 18 of adjustable height supported over the passageway in register therewith. A coin counting mechanism 160 including a toothed wheel 19 is provided adjacent the exit end of the passageway 17, the toothed wheel 19 being caused to rotate through an angle corresponding to the pitch of the teeth on its circumference by each coin of the preselected denomination traveling therepast. Each time a predetermined number of coins are thus fed out of the exit end of the passageway 17, the toothed wheel 19 is temporarily locked against any further rotation to prevent any additional coins from being fed out of the passageway.

Figure 2:
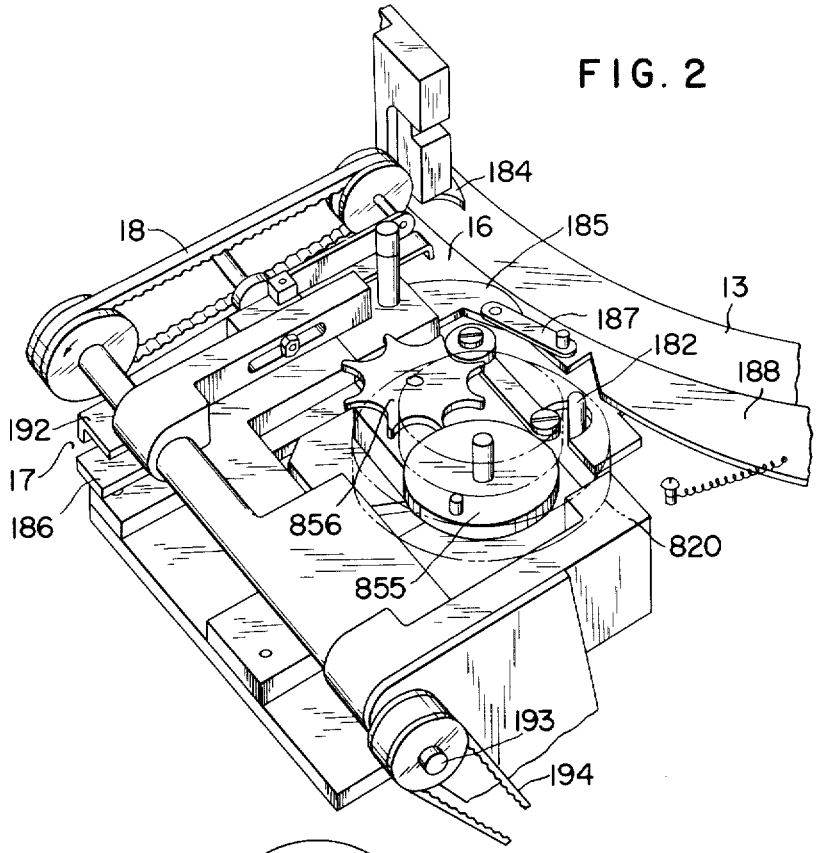
FIG. 2 is an enlarged fragmentary perspective view showing part of an infeed mechanism in the apparatus of FIG. 1.

FIG. 2 illustrates in greater detail the constructional features of some of the above described constituent parts or components of the infeed mechanism 1. The rotary disk 13 is pivotally supported at its central axis for rotation in the direction of the arrow in FIG. 1. A guide wall member 180 of arcuate shape is mounted over the circumferential portion of the rotary disc 13 opposite to the endless moving belt 12. The guide wall member 180 extends through an angle of approximately 180 degrees, and the aforesaid wall member 15 extends between one end of the guide wall member 180 and the adjustable width gate 16.

The wall member 15 is supported on the underside of an openable cover 181 in such a manner that, upon closure of this cover 181, the lower edge of the wall member 15 will be held above the face of the rotary disc 13 at a distance corresponding to the thickness of each of the coins to be packaged. To this end, the position of the wall member 15 relative to the rotary disc 13 is made adjustable by mounting the wall member on the underside of the cover 181 via spring means, not shown, and by providing a projection 182 which is movable up and down as dictated by the control mechanism 8.

The adjustable width gate 16 comprises a stationary guide 184 projecting onto the rotary disc 13 for guiding successive coins onto the passageway 17 as they travel along the inside surface of the wall member 15, and a movable guide 185 which moves toward and away from the stationary guide 184 for defining a gate width corresponding to the diameter of the coins to be packaged. The movable guide 185 is an integral part of a movable member 186 defining one of the lateral edges of the passageway 17. The movable member 186 is further coupled via a link 187 to an arcuate guide 188 arranged circumferentially of the rotary disc 13 to provide a guide surface leading to the gate 16 such that the coins will be smoothly directed into the passageway 17 in spite of the varying width of the gate 16.

The movable member 186 defining one of the lateral edges of the passageway 71 is movable toward and away from a stationary member 184 defining the other lateral edge of the passageway in order to determine the width of this passageway in accordance with the diameter of the coins to be packaged. Such movement of the movable member 186 is also regulated by the control mechanism 8.

The coins in the passageway 17 are fed as aforesaid in frictional contact with the overhead endless moving belt 18 arranged longitudinally of the passageway and extending around a pair of terminal pulleys 189 and 190. A support 191 rotatably supporting the shafts of the respective pulleys 189 and 190 and a holding plate 192 are both movable up and down relative to the passageway 17 as dictated by the control mechanism 8 in accordance with the thickness of each of the coins to be packaged. A first motor $M_1$ imparts rotation, via an endless belt 194, to the pulley shaft 193 in the direction of the arrow in FIG. 2.

Figure 3:
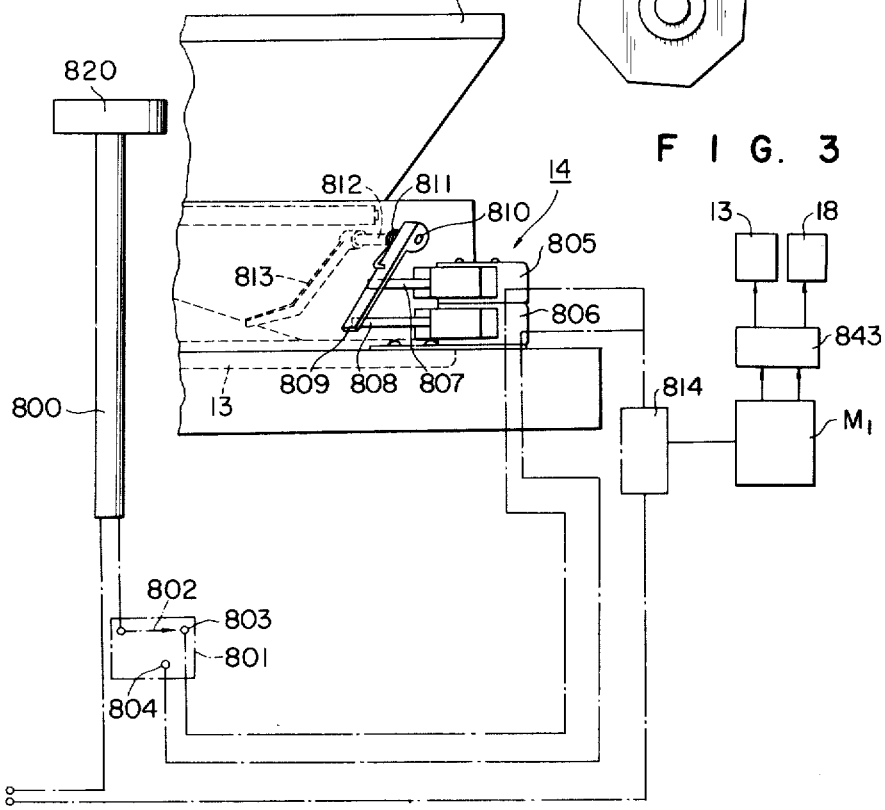
FIG. 3 is an enlarged, fragmentary, side elevational view showing a coin sensing mechanism in the apparatus of FIG. 1 in combination with associated electrical circuitry.

FIG. 3 illustrates the details of the sensing mechanism 14, which includes the movable contact 802 of a rotary switch 801 adapted to be actuated by a rotary shaft 800 having a knob 820 on its top, the rotary shaft 800 being adapted to be rotated to a desired angular position in accordance with the size of the coins to be packaged, as later described in more detail. The rotary switch 801 further comprises fixed contacts 803 and 804 which are connected to respective switches 805 and 806. In this particular embodiment of the invention, coins of several different denominations to be handled by the apparatus are previously divided into two groups according to their size, and the switches 805 and 806 are provided corresponding to the respective groups of coins.

It will be noted from FIG. 3 that the switches 805 and 806 are disposed in vertically registered relationship to each other, with their respective actuators 807 and 808 coupled to a common lever 809 pivotally supported at 810 on the above mentioned guide wall member 180. The switches 805 and 806 will thus be opened in predetermined different angular positions of the lever 810. The lever 810 is biased, as by a torsion spring 811, in a direction tending to close the switches 805 and 806. The pin 810 pivotally supporting the lever 809 has its end 812 projecting inwardly of the guide wall member 180 and coupled to one end of a sensing lever 813 adapted to be turned by the coins on the rotary disc 13.

The switches 805 and 806 in parallel relationship are serially connected to the supply circuit of an electromagnetic clutch 814 connected to the first motor $M_1$. It is assumed that the output shaft of the first motor $M_1$ is coupled to the rotary disc 13 and is further utilized to drive the endless belts 12 and 18.

In the operation of this sensing mechanism 14, the movable contact 802 of the rotary switch 801 is assumed to be closed to the fixed contact 804 when smaller-sized coins are to be handled by the apparatus. Thus, when an excessive number of such coins are loaded on the rotary disc 13, the sensing lever 813 is thereby turned in step with the lever 809 against the force of the torsion spring 811, until at last the switch 806, is opened by the actuator 808. Thereupon the first motor $M_1$ stops driving the endless belt 12, so that no more coins are delivered from the hopper 11 to the rotary disc 13. As the number of coins on the rotary disc 13 decreases due to its continued rotation, the sensing lever 813 is gradually relieved of its load, until the switch 806 becomes reclosed. The endless belt 12 becomes operative again via the clutch 814 to resume the delivery of coins onto the rotary disc 13. It will now be apparent that the rotary disc 13 is thus always supplied with an appropriate amount of coins.

When larger-sized coins are handled by the apparatus, the movable contact 802 of the rotary switch 801 is closed to the other fixed contact 803, so that the endless belt 12 is driven by the first motor $M_1$ which is operated through the path comprising the contacts 802 and 803 of the rotary switch 801, the switch 805, and the electromagnetic clutch 814. Even though the switch 806 is opened before the switch 805 by the above described procedure, the the first motor $M_1$ is held energized via the switch 805, so that coins are further delivered onto the rotary disc 13 by the endless belt 12. The sensing lever 813 is thus turned further until the switch 805 is opened by its actuator 807. The delivery of coins to the rotary disc 13 is now suspended and is succeedingly resumed when the amount of coins on the rotary disc decreases to a predetermined degree.

While the rotary disc 13 can be supplied with coins at a proper rate depending upon the approximate size of the coins by the sensing mechanism shown in FIG. 3, various modifications thereof will readily occur to those skilled in the art. For example, switches 805, 806, and so forth, may be provided correspondingly to the coins of the respective denominations to be handled by the apparatus. It is also possible that, instead of providing a plurality of such switches, there may be provided a single switch which is movable relative to the lever 809 so as to be actuated in different angular positions of the lever.

COIN COUNTING MECHANISM

Figure 4:
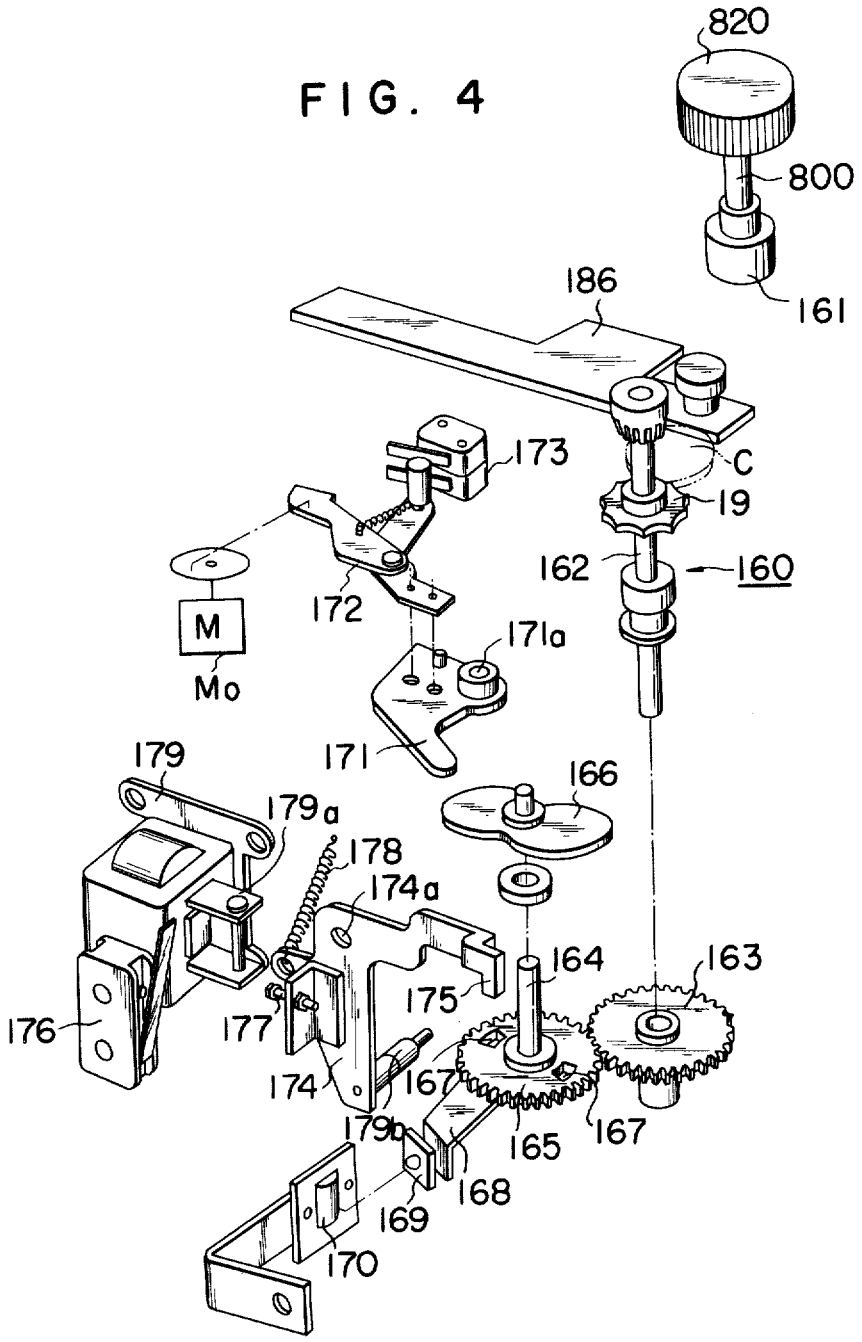
FIG. 4 is an exploded perspective view showing a coin counting mechanism in the apparatus of FIG. 1.

As illustrated in FIG. 4, a multiposition switch 161 is mounted on the aforesaid rotary shaft 800 to be rotated by the knob 820. The toothed counting wheel 19, having its circumference divided into ten identical concavities, is disposed in coplanar relationship to the movable member 186 defining one of the lateral edges of the coin passageway 17. The counting wheel 19 is fixedly mounted on a shaft 162, on which shaft there is also fixedly mounted a gear 163 meshing with a gear 165 secured to a shaft 164 extending parallel to the shaft 162. A resetting cam 166 is likewise fixedly mounted on the shaft 164. The intermeshing gears 163 and 165 are of the same diameter, and a pair of apertures 167 are formed through the gear 165 in diametrically opposed positions thereof. The resetting cam 166 has a pair of rounded portions disposed on the opposite sides of the shaft 164.

A pair of levers 168 are mounted on the underside of the gear 165 so as to partly project outwardly from its circumference, and each lever 168 carries a magnet 169 on its outer end adapted to operate a reed switch 170 supported in a suitable manner. Pivotally supported at 171a adjacent the resetting cam 166 is a lever 171, which is biased by a spring, not shown, in a direction to be held out of engagement with the cam 166. The lever 171 is fixedly provided with a return lever 172 consisting of two separate parts interconnected with a spring as shown in the drawing and adapted to actuate a switch 173. When not actuated by the return lever 172, the switch 173 functions to keep the apparatus out of operation. The return lever 172 oscillates with each complete revolution of a motor $M_o$.

A lever 174 pivotally supported by a pin, not shown, inserted into a bore 174*a* is adapted to terminate the delivery of coins. A detent 175 is formed on one of the ends of the lever 174 so as to project into either of the diametrically opposed apertures 167 in the gear 165, and a pin is carried at 177 on the lever 174 so as to actuate a switch 176 adapted to initiate the operation of the coin wrapping mechanism 4. The lever 174 is biased into contact with one of the faces of the gear 165 by a helical tension spring 178. Coupled to the actuator 179*a* of an electromagnet 179 via a pin 179*b*, the lever 174 can be turned against the force of the spring 178.

Figure 5:
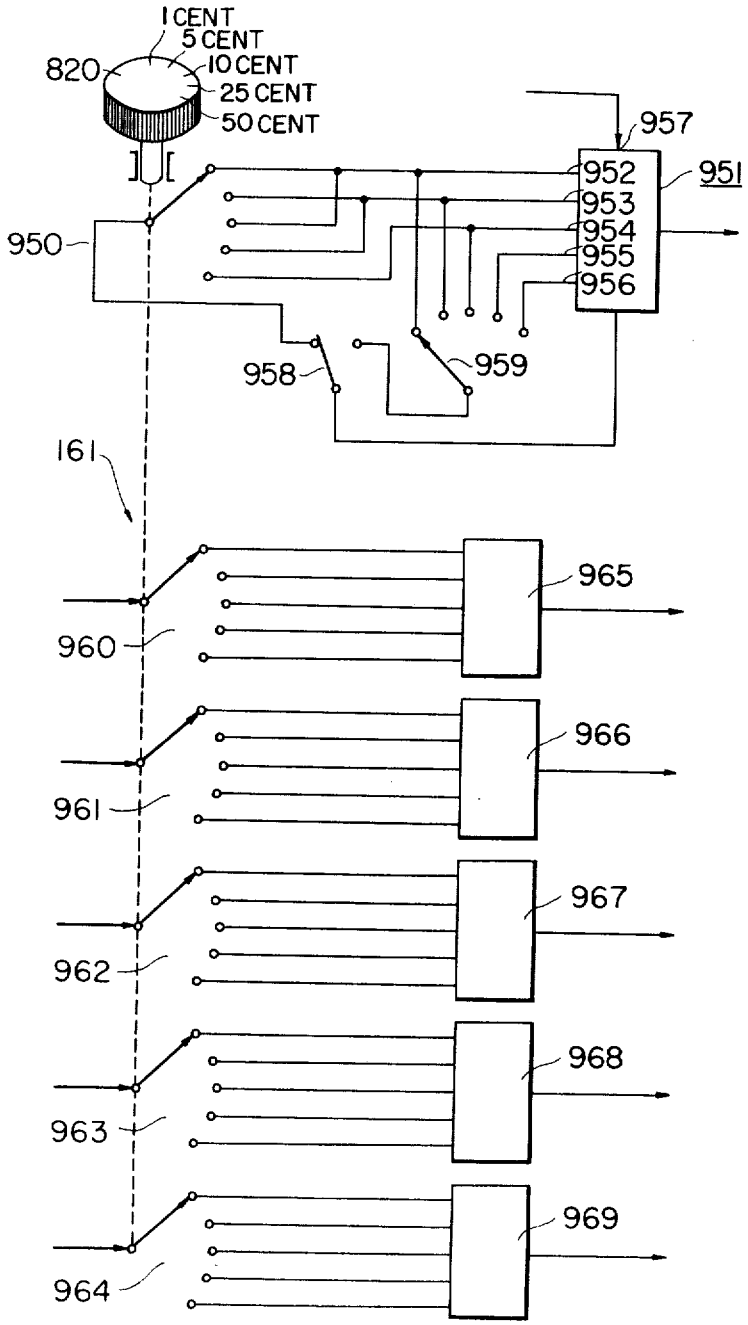
FIG. 5 is a schematic electrical diagram showing the control circuit of the mechanism of FIG. 4.

FIG. 5 illustrates the electrical circuitry of the coin counting mechansim 160, in which it is assumed that when coins of a specific denomination to be handled by the apparatus are selected, the apparatus will automatically determine the specific number of the coins to be arranged into each package. The multiposition switch 161 comprises six circuits each having five fixed contacts. The knob 820 for operating this multiposition switch 161 has calibrations representing, for example, 1-, 5-, 10-, 25- and 50-cent coins respectively.

One of the circuits, 950, controlled by the multiposition switch 161 is connected to counting means 951 adapted to determine the number of coins to be arranged into each package. The counting means 951 is provided with a 50-coin package terminal 952, 40-coin package terminal 953, 20-coin package terminal 954, and two other terminals 955 and 956 for permitting any number of coins to be arranged into each package as desired by the operator, and these terminals are connected to the contacts of the circuit 950 as in the drawing. The aforesaid reed switch 170 is connected to an input terminal 957. In this particular embodiment of the invention, the 1- and 10-cent coin contacts of the circuit 950 are connected to the 50-coin package terminal 952, the 5- and 25-cent coin contacting the 40-coin package terminal 953, and the 50-cent coin contacting the 20-coin package terminal 954.

A selector switch 958 is adapted for selection between manual and automatic operations, and the manual operation contact of this selector switch 958 is connected to the movable contact of a rotary switch 959 which permits the operator to select manually the number of coins to be enclosed in a single package. The fixed contacts of the other circuits 960 to 964 are connected, respectively, to means 965 for adjusting the width of the coin passageway 17, means 966 for adjusting the inside diameter of a coin stacking cylinder to be described hereinafter, means 967 for adjusting the relative positions of wrapping rolls later to be described, means 968 for adjusting the length of each strip of wrapper used for packaging a single stack of coins, and means 969 for adjusting the positions of fold crimping hooks relative to each stack of coins placed in a prescribed packaging position, as hereinafter set forth in more detail.

In the operation of the coin counting mechanism shown in FIGS. 4 and 5, the knob 820 may first be rotated to a desired angular position in accordance with the denomination of coins to be packaged. The movable contacts of the multiposition switch 161 are thus closed to the required fixed contacts, respectively, of the circuits 950 and 960 to 964, thereby initiating the desired operations of the counting means 951 and the adjusting means 965 to 969. The coins to be packaged are then charged into the hopper 11, the coins being conveyed onto the rotary disc 13 by the endless moving belt 12. As the disc 13 rotates at a proper speed, the coins are successively sent out centrifugally into the passageway 17 in the manner previously described.

Each of the coins being fed out of the passageway 17 causes the rotation of the toothed counting wheel 19 through the predetermined angle. The intermeshing gears 163 and 165 and the levers 169 carrying the respective magnets 169 rotate in phase with the counting wheel 19, completing a complete revolution as each ten successive coins are fed out of the passageway 17. Since the pair of magnets 169 are arranged in diametrically opposed positions with respect to the gear 165, the reed switch 170 will be actuated twice with each complete revolution of the counting wheel 19 and so forth. Each time the reed switch 170 is actuated by either of the magnets 169, an electric pulse is delivered to the counting means 951. Upon delivery of a preset number of such pulses to the counting means 951, a signal is thereby produced which is effective to deenergize the electromagnet 179.

The detent 175 formed on one of the ends of the lever 174 is then caused by the spring 178 to engage either of the apertures 167 in the gear 165 and hence to arrest its rotation, so that the toothed counting wheel 19 is prevented from rotation via the gear 163 and the shaft 162. No more coins can now be fed out of the exit end of the passageway 17. Simultaneously, the pin 177 carried by the lever 174 moves out of contact with the switch 176 to initiate the operation of the coin wrapping mechanism 4. Upon completion of the operation of the coin wrapping mechanism 4, the camshaft 48 shown in FIG. 1 operates to energize the electromagnet 179 again, so that the toothed counting wheel 19 becomes rotatable to resume the counting of coins as they successively leave the exit end of the passageway 17.

At the instant when the counting of coins of a different denomination is started following the packaging of all the coins by the repetition of the above described procedure, the return lever 172 is turned to move the lever 171 toward the resetting cam 166. The lever 171 rotates the resetting cam 166 until the gear 165 assumes its prescribed angular position for initiation of the next counting operation. The switch 173 is actuated simulatneously to reset the counting means 951, FIG. 5, to zero. The knob 820 may then be turned manually to re-adjust to the denomination of the coins to be packaged next, with the result that the counting means 951 and the adjusting means 965 to 969 are re-adjusted correspondingly and are thus made ready for the succeeding coin packaging operation.

In the case where an arbitrarily desired number of coins are to be enclosed in each package, the movable contact of the selector switch 958 is changed over from the illustrated position and connected to the other fixed contact permitting manual selection by the rotary switch 959. The movable contact of this rotary switch 959 may then be closed to any of its fixed contacts corresponding to the desired number of coins to be enclosed in each package. Instead of the switch 173 of the configuration shown in FIG. 4, there may be provided a pair of switches 176 in juxtaposition, with one of such juxtaposed switches employed in place of the switch 173.

OPERATION SELECTOR MECHANISM

Figure 6:
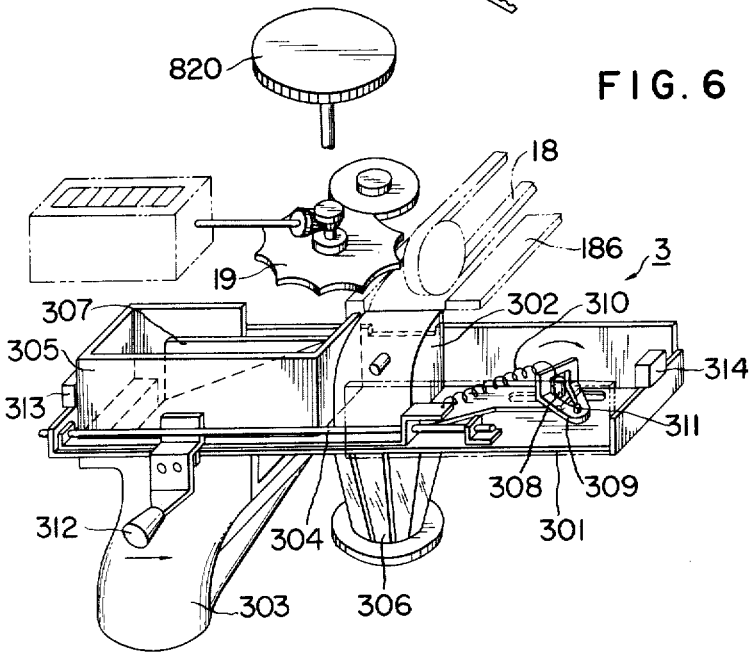
FIG. 6 is a perspective view showing an operation selector mechanism in the apparatus of FIG. 1.

As will be seen from FIGS. 1 and 6, the operation selector mechanism 6 includes a frame 301 supported adjacent the exit end of the coin passageway 17. The frame 301 is substantially integrally provided with a chute 302 through which the coins fed out of the passageway 17 are directed down to the coin stacking mechanism 2 and with another chute 303 through which the coins are recovered in case the apparatus is required to perform a coin counting operation only. The frame 301 is further provided with an operation selector member 305 which is movable back and forth along guide 304 carried by the frame.

The operation selector member 305 is provided with a chute 306 which, when moved into register with the exit end of the passageway 17, directs the successive coins down in the coin stacking mechanism 2 and with a chute 307 which, when moved into register with the exit end of the passageway 17, guides the coins into the chute 303 for recovery. A pin 308 carried by the selector member 305 is adapted to be engaged by a lever 309 pivotally mounted on the frame 301, and a helical tension spring 310 extends between this lever 309 and the frame 301. Thus, the operation selector member will be securely retained in either of its two predetermined operative positions by the spring 310 located on either of the opposite sides of the pin 311 pivotally supporting the lever 309. With the selector member 305 thus retained in either of its operative positions, the corresponding one of the chutes 303 and 306 will be held in register with the exit end of the passageway 17. The selector member 305 is manually movable by a handle 312 fixedly attached thereto.

A pair of switches 313 and 314 mounted on the opposite ends, respectively, of the frame 301 are each adapted to be actuated by the operation selector member 305 when the same is moved to the corresponding one of its two operative positions. Unless either of these switches 313 and 314 is actuated by the selector member 305, the operation of the coin packaging apparatus will not be initiated.

COIN STACKING MECHANISM

Figure 7:
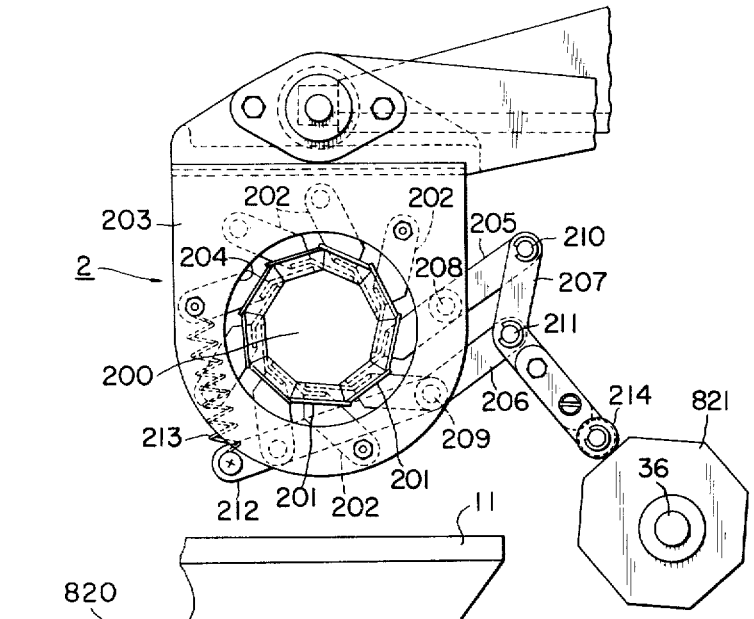
FIG. 7 is a top plan view showing a coin stacking mechanism in the apparatus of FIG. 1.

The coin stacking mechanism 2 includes a stacking cylinder generally designated by the numeral 200 in FIGS. 1 and 7 and disposed under the chute 306 of the above described operation selector mechanism 3 in direct communication therewith. The stacking cylinder 200 has its bottom end openably closed by shutter means 250 as shown in FIG. 1.

As best illustrated in FIG. 7, the stacking cylinder 200 is composed of a plurality of rectangular plate members 201 arranged in overlapping relationship with respect to each other as in the drawing, When viewed cross-sectionally, therefore, the stacking cylinder 200 is of regularly polygonal shape approximating a circle. The upper end portions of the plate members 201 constituting the stacking cylinder 200 are flared in order that the coins delivered through the chute 306 may be smoothly received therein.

A plurality of support members 202 project outwardly from the respective plate members 201, and the outer ends of all these support members 202 are pivotally attached to a bracket 203 at points arranged circumferentially of a notional circle concentric with a circular aperture 204 of the bracket adapted to accommodate the stacking cylinder 200 in coaxial relationship. Any two of the support members 202 are pivotally connected at 208 and 209 to arms 205 and 206, respectively, and these arms 205 and 206 are further pivotally connected at 210 and 211, respectively, to an adjusting lever 207. It will be noted from FIG. 7 that the four pins 208 to 211 pivotally interconnecting the support member 202, the arms 205 and 206, and the adjusting lever 207 are located at the respective corners of a regular trapezoid.

The arm 206 has an extension 212, and a helical tension spring 213 extends between the tip of this extension 212 and the bracket 203 so that the constituent plate members 201 of the stacking cylinder 200 are biased in a direction tending to reduce its inside diameter. The adjusting lever 207 rotatably supports a roll 214 adapted to function as a cam follower to be actuated by a cam 821 of polygonal shape. The circumferential contour of this cam 821 is such that the inside diameter of the stacking cylinder 200 may be thereby adjusted to the outside diameters of the various denominations of coins to be handled by the apparatus. If desired, there may be additionally provided suitable means for imparting vibration to the stacking cylinder 200.

In the coin stacking mechanism 2 constructed as hereinabove described with reference to FIGS. 1 and 7, the cam 821 may be turned to a specific angular position predetermined in accordance with the diameter of the coins to be packaged, thereby actuating the adjusting lever 207 via the roll 214. The arms 205 and 206 are thus turned about the pivots 210 and 211 respectively, whereby the plate members 201 are moved simultaneously via the support members 202 to increase or decrease the inside diameter of the stacking cylinder 200 as dictated by the angular position of the cam 821.

As will be seen from FIG. 1, the shutter means 250 openably closing the bottom end of the stacking cylinder 200 comprises a pair of rectangular plate members 250*a* and 250*b* disposed in coplanar relationship to each other. These plate members 250*a* and 250*b* are adapted to be simultaneously moved toward and away from each other by a linkage system 251 which is actuated by the drive mechanism 9, holding the bottom end of the stacking cylinder 200 closed while the coins are being stacked up therein and opening the same upon completion of the coin stacking operation.

Figure 8:
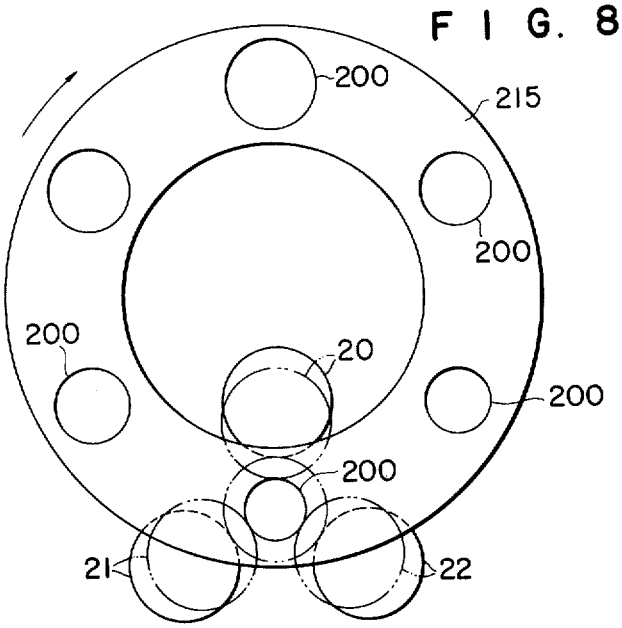
FIG. 8 is a schematic top plan view showing a modification of the coin stacking mechanism.

FIG. 8 illustrates a possible alternative to the adjustable diameter stacking cylinder 200 shown in FIGS. 1 and 7. In this alternative arrangement shown in FIG. 8, a plurality of stacking cylinders 200 of different inside diameters, provided correspondingly to the diameters of several denominations of coins to be handled by the apparatus, are fixedly supported by a rotatable support 215 of annular shape in circumferentially spaced-apart positions. Thus, by the rotation of the support 215, any desired one of the stacking cylinders 200 may be brought to the predetermined coinreceiving position, in which the axis of the stacking cylinder is aligned with the central axis between wrapping rolls 20, 21, and 22, as later described in further detail.

Figure 9:
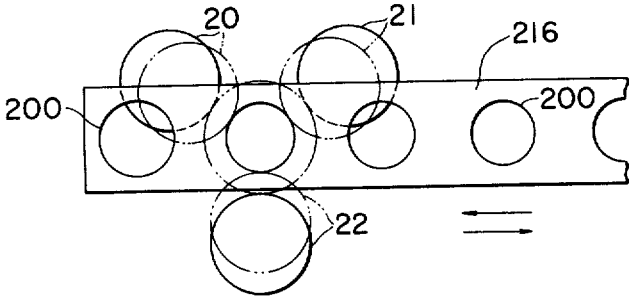
FIG. 9 is a similar view showing another modification of the coin stacking mechanism.

FIG. 9 illustrates a modification of the arrangement shown in FIG. 8, in which the stacking cylinders 200 of different inside diameters are carried by a linearly extending support 216 which is reciprocably movable past the central axis between the wrapping rolls 20 through 22 to bring any desired stacking cylinder to the coin-receiving position.

COIN WRAPPING MECHANISM

Figure 10:
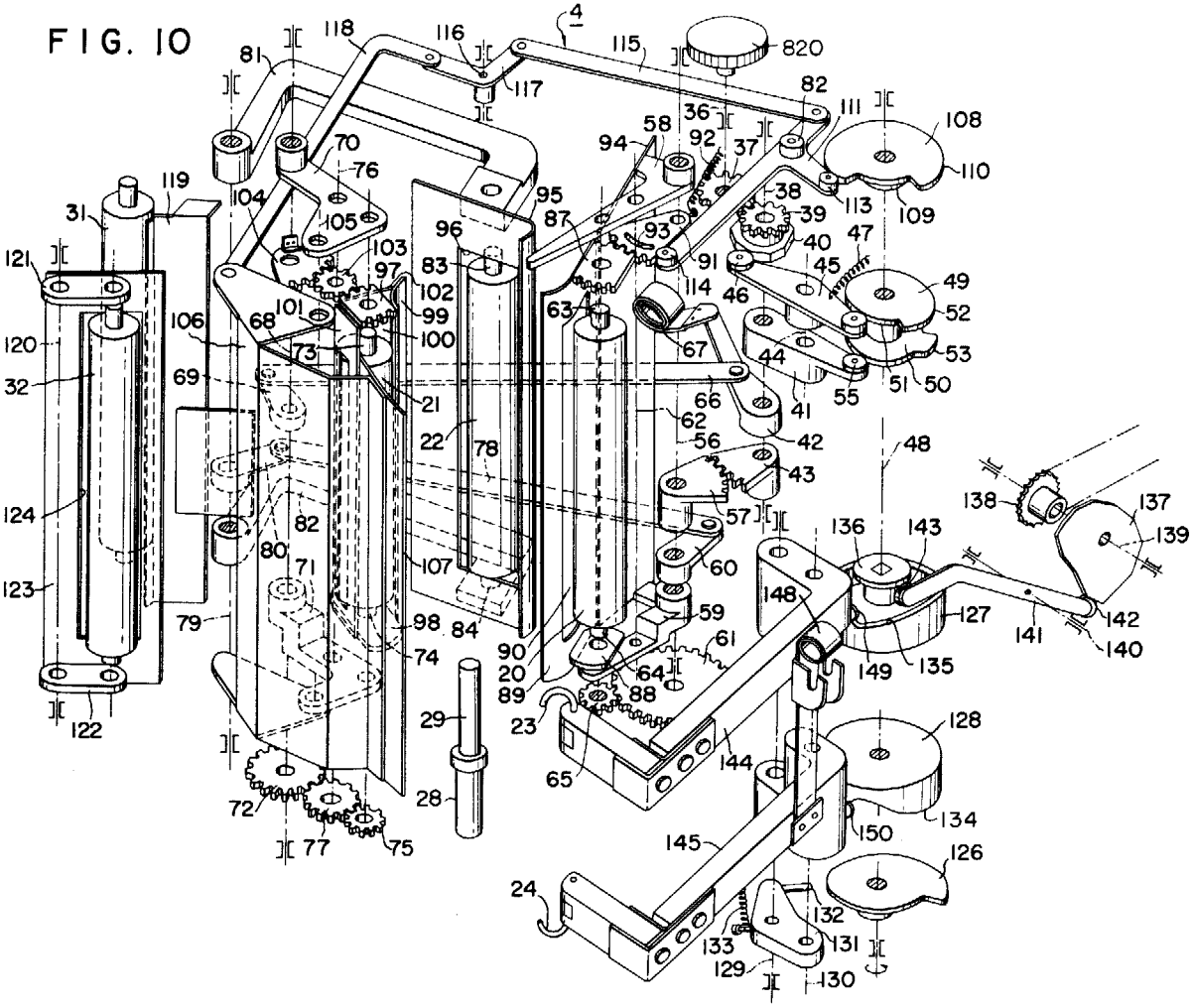
FIG. 10 is an exploded perspective view showing a coin wrapping mechanism in the apparatus of FIG. 1.

In FIG. 10 illustrating the details of the coin wrapping mechanism 4, it will be noted that bores formed in some parts are hatched, and those formed in other parts unhatched. This is to indicate that the parts having hatched bores are fixedly mounted on shafts, rods or pins received in such bores, and the other parts having unhatched bores are loosely mounted on shafts or the like received in such bores, thereby facilitating the following description of the coin wrapping mechanism.

The aforesaid knob 820 to be turned in accordance with the denomination of the coins to be packaged is assumed to be coupled to a shaft 36 either directly or via rotary switch, motor, cam or like means not shown in the drawing. A gear 37 mounted on this shaft 36 meshes with a gear 39 mounted on a shaft 38, on which latter shaft there is also mounted a cam 40 adapted to determine the distances the wrapping rolls 20, 21, and 22 are to be moved in a manner hereinafter set forth.

Figure 11:
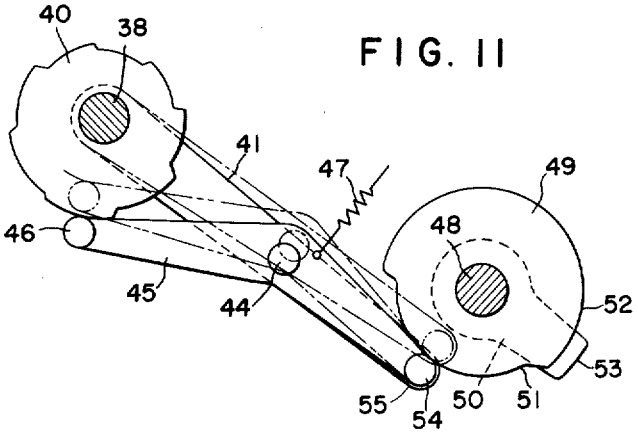
FIG. 11 is an enlarged top plan view showing means for controlling the most spaced-apart, intermediate, and least spaced-apart positions of wrapping rolls in the coin wrapping mechanism of FIG. 10 in accordance with the diameter of coins to be packaged.

As seen more clearly in FIG. 11, the cam 40 has a stepped circumferential contour, such that the distance between its axis of rotation and its circumference varies in steps corresponding to the diameters of the various denominations of coins to be handled by the apparatus.

Arms 41 and 42 and a sector gear 43 are further mounted on the shaft 38, and a shaft 44 extends approximately centrally through the arm 41. The shaft 44 also extends approximately centrally through a lever 45 to pivotally support the same above the arm 41. The lever 45 carries a roll 46 on one end thereof which is yieldably urged against the stepped circumference of the cam 40 as by a helical tension spring 47.

As seen in both FIGS. 10 and 11, cams 49 and 50 are mounted on a shaft 48 which is caused to make one complete revolution for each cycle of the coin packaging operation. The cam 49 has at its circumference an arcuate edge 51 of a reduced radius adapted to cause the wrapping rolls 20 through 22 to be located in their least spaced-apart positions with respect to each other, and with another arcuate edge 52 of a greater radius adapted to cause the wrapping rolls to be located in their intermediate positions, as hereinafter set forth in more detail. The other cam 50 has a tongue 53 projecting from its circumference and is adapted to cause the wrapping rolls to be located in their most spaced-apart positions. The cam 49 has its circumference of the above described contour held in contact with a roll 54 mounted on the other end of the lever 45, whereas the cam 50 makes contact only at its tongue 53 with a roll 55 mounted on the corresponding end of the arm 41.

The sector gear 43 mounted on the shaft 38 meshes with another sector gear 57 mounted on a shaft 56. Also mounted on this shaft 56 are arms 58, 59 and 60 and a gear 61, which gear is adapted to convey the rotation of a second motor $M_2$, FIG. 1, to the wrapping roll 20. The arms 58 and 59 are interconnected at their respective intermediate points by a pin or rod 62 extending vertically therebetween, and the wrapping roll 20 is rotatably supported between the free ends of the arms 58 and 59 via shafts 63 and 64 extending axially outwardly from both ends of the wrapping roll. A pinion 65 mounted on the shaft 64 meshes with the gear 61 to receive therefrom the rotation of the second motor $M_2$.

The arm 42 on the shaft 38 has its free end pivotally coupled to one end of a link 66 and further to a spring 67 capable of providing a constant load, and the other end of the link 66 is pivotally coupled to one end of an arm 69, the other end of which is secured to a shaft 68. Also mounted on this shaft 68 is a cooperative pair of arms 70 and 71 rotatably supporting the wrapping roll 21 between the free ends thereof via shafts 73 and 74 extending axially outwardly from the two ends of the wrapping roll. A gear 72 mounted on the shaft 68 meshes with a pinion 75 on the shaft 74 of the wrapping roll 21 via an intermediate gear 77 mounted on a shaft 76 extending vertically through the arms 70 and 71, so that the wrapping roll 21 also is rotated by the aforesaid second motor $M_2$.

The arm 60 on the shaft 56 has its free end pivotally coupled to one end of a link 78 the other end of which is pivotally coupled to an arm 80 mounted on a shaft 79. Also mounted on this shaft 79 is a cooperative pair of arms 81 and 82, each substantially in the shape of a U, rotatably supporting the wrapping roll 22 between the free ends thereof via shafts 83 and 84 extending axially outwardly from the two ends of the wrapping roll.

Figure 14:
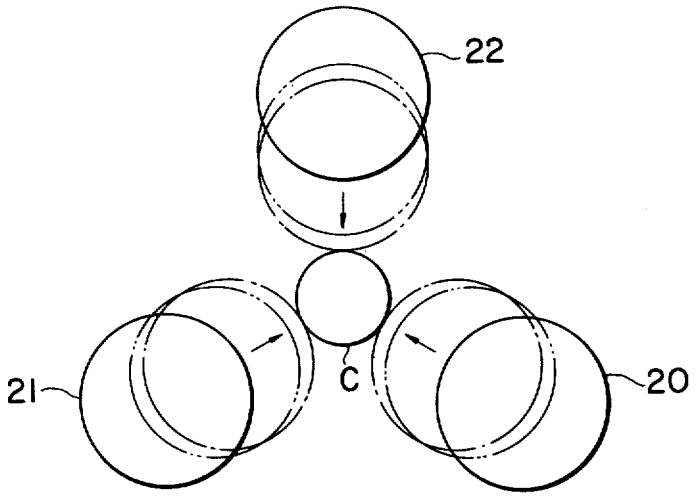
FIG. 14 is a schematic top plan view for explaining the way the wrapping rolls travel from their most spaced-apart to least spaced-apart positions via intermediate positions for wrapping a stack of coins of relatively small diameter in the coin wrapping mechanism of FIG. 10.
Figure 15:
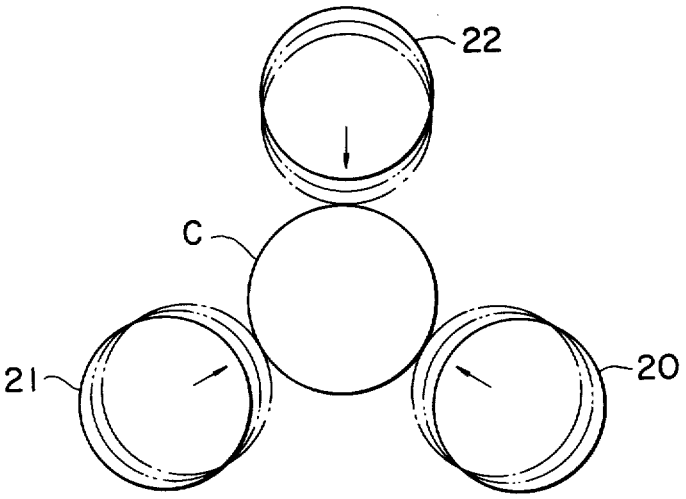
FIG. 15 is a similar view for explaining the way the wrapping rolls travel from their most spaced-apart to least spaced-apart positions via intermediate positions for wrapping a stack of coins of relatively large diameter in the coin wrapping mechanism of FIG. 10.

As best seen in FIGS. 14 and 15, the wrapping rolls 20 through 22 are located at the apexes, respectively, of an equilateral triangle. By the motion of their respective supporting arms set forth above with reference to FIG. 10, the wrapping rolls 20 through 22 move toward and away from the central axis therebetween in order to hold or release the stack of coins C supported on the top of a guide rod 29 disposed in alignment with the central axis between the wrapping rolls.

Figure 12:
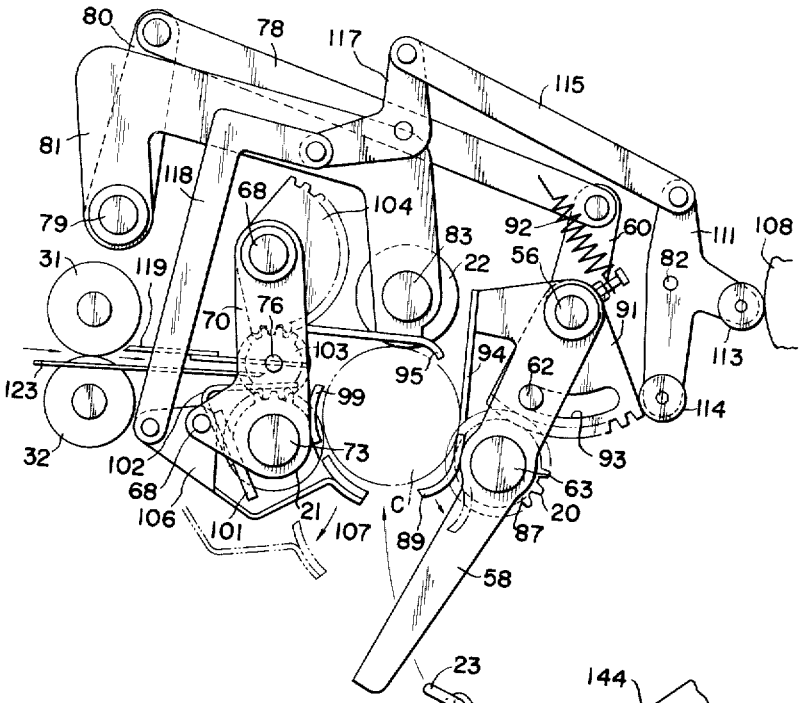
FIG. 12 is a top plan view for explaining the positions assumed by the wrapping rolls and by wrapper guides for wrapping a stack of coins of relatively large diameter in the coin wrapping mechanism of FIG. 10.
Figure 13:
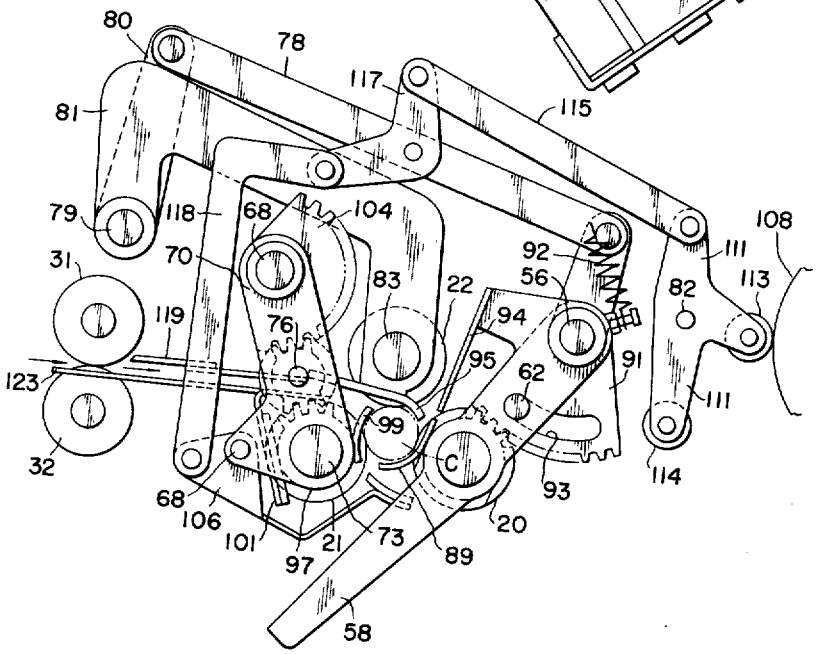
FIG. 13 is a similar view for explaining the positions assumed by the wrapping rolls and by the wrapper guides for wrapping a stack of coins of relatively small diameter in the coin wrapping mechanism of FIG. 10.

Also illustrated in FIGS. 10, 12 and 13 is a wrapper guide mechanism including a gear 87 and a support 88 mounted on the shafts 63 and 64, respectively, of the wrapping roll 20. These gear 87 and support 88 carry a wrapper guide 89 extending therebetween and having a width at least equal to the smallest of the various diameters of coins to be handled by the apparatus. Approximately one longitudinal half of this wrapper guide 89 is of arcuate crosssectional shape, with a curvature substantially the same as that of the coins of the smallest diameter. The wrapper guide 89 has a longitudinal aperture 90 adapted to permit the wrapping roll 20 to project partly therethrough.

The gear 87 on the shaft 63 of the wrapping roll 20 meshes with a sector gear 91 mounted on the shaft 56. The sector gear 91 is biased by a helical tension spring 92 as best shown in FIGS. 12 and 13 and has an arcuate aperture 93 adapted to slidably receive the shaft 62 therethrough. A planar guide 94 is carried by the arms 58 and 59 so as to constitute a substantial extension of the aforesaid guide 89.

Another wrapper guide 95 is carried by the arms 81 and 82 supporting the wrapping roll 22. The wrapper guide 95 has a width at least equal to the greatest of the various diameters of coins to be packaged. A longitudinal aperture 96 is likewise provided in this wrapper guide 95 to permit the wrapping roll 22 to project partly therethrough. One of the lateral edges of the wrapper guide 95 is curved inwardly, with a curvature substantially the same as that of the coins of the smallest diameter to be packaged.

A further wrapper guide 99 is carried by a gear 97 and a support 98 which are mounted on the shafts 73 and 74, respectively, of the wrapping roll 21. The wrapper guide 99 has a width at least equal to the smallest of the various diameters of coins to be packaged and includes a portion which is of arcuate cross-sectional shape, with a curvature substantially the same as that of the coins of the smallest diameter. A longitudinal aperture 100 is provided in the wrapper guide 99 to permit the wrapping roll 21 to project partly therethrough.

A wrapper guide 101 of substantially L-shaped cross section is also carried by the gear 97 and the support 98 on the opposite side with respect to the wrapper guide 99. The wrapper guide 101 has its lateral edge 102 located adjacent one of the lateral edges of the wrapper guide 99. The gear 97 meshes with a gear 103 mounted on the shaft 76, while this gear 103 meshes with a sector gear 104 which is mounted on the shaft 68, and which is secured to a stationary part, not shown, of the apparatus. A plate member 106 is turnably supported by a shaft 105 extending through the pair of arms 70 and 71, the plate member being so shaped and arranged as to externally surround the wrapping roll 21. Fixedly supported on one of the lateral edges of the plate member 106 is a wrapper guide 107 which is located between the above mentioned wrapper guides 89 and 99 and which is of arcuate cross section, with a curvature substantially the same as that of the coins of the greatest diameter to be packaged.

A wrapper guide control cam 108 mounted on the shaft 48 is adapted to control the movements of the wrapper guides 89 and 107 with relation to the movements of the crimping hooks 23 and 24. The cam 108 includes a circumferential edge portion 109 of a smaller radius for holding the wrapper guides in their operative positions and another circumferential edge portion 110 of a greater radius for holding the wrapper guides in their inoperative positions as the crimping hooks 23 and 24 advance toward their operative positions.

A substantially T-shaped arm 111 pivotally supported by a shaft 82 carries a roll 113 abutting the wrapper guide control cam 108 and another roll 114 abutting one side of the sector gear 91. The T-shaped arm 111 is pivotally coupled to a link 115 which is further pivotally coupled to an L-shaped link 117 turnably mounted on a shaft 116. The L-shaped link 117 is pivotally coupled to a link 118 which is further pivotally coupled to the plate member 106 at its end remote from the wrapper guide 107.

A pair of wrapper feed rolls are juxtaposed at 31 and 32, and a wrapper guide 119 is fixedly supported adjacent the roll 31 by some stationary parts, not shown, of the apparatus. The other roll 32 is rotatably supported by a pair of brackets 121 and 122 which are both swingably supported by a shaft 120, so that the roll 32 is movable toward and away from the roll 31. Also supported by the brackets 121 and 122 is a wrapper guide 123 which is disposed in confronting relationship to the wrapper guide 119 and the roll 31, and which is provided with a longitudinal aperture 124 adapted to permit the roll 32 to project partly therethrough.

As also illustrated in FIG. 10, there are three crimping hook control cams 126, 127 and 128 mounted on the shaft 48 for controlling the movements of the crimping hooks 23 and 24. Adjacent the lowermost cam 126 adapted to cause the crimping hooks 23 and 24 to move between their operative and inoperative positions, there is provided a movable member 131 through which a pair of parallel spaced shafts 129 and 130 extend. A cam follower pin 132 affixed to the movable member 131 is urged by a helical tension spring 133 into abutment with the circumference of the cam 126.

The other two cams 127 and 128 are adapted to cause the up-and-down motion of the crimping hooks 23 and 24 toward and away from each other. The cam 128 has its bottom edge 134 shaped into the desired cam contour, whereas the cam 127 has its top edge 135 shaped into the desired cam contour and is further provided with an annular recess 136. It may be noted from the showing of FIG. 10 that the cam 127 is mounted on that portion of the shaft 48 which is square in cross section, so as to be movable up and down relative to the same but rotatable together therewith.

A cam 137, adapted to be turned to a specific angular position in accordance with the denomination and number of coins to be enclosed in each package, is fixedly mounted on the same shaft 139 as a gear 138 which is driven by the second motor $M_2$ shown in FIG. 1. A cam follower roll 142 mounted on one end of an arm 141 pivotally mounted on a shaft 140 abuts on the cam 137, while a roll 143 mounted on the other end of the arm 141 is operatively received in the annular recess 136 of the cam 127.

A pair of brackets 144 and 145 are mounted, each at or adjacent one end thereof, on the parallel spaced shafts 129 and 130 so as to be movable up and down relative to the same. The crimping hooks 23 and 24 are affixed to the other ends of the respective brackets 144 and 145. A constant load spring 148 is mounted across the brackets 144 and 145 in order to urge the same toward each other. Cam follower rolls 149 and 150 carried by the brackets 144 and 145 abut the cam contours 135 and 134 respectively.

WRAPPER FEED MECHANISM

As will be seen from FIGS. 1 and 16, a plurality of rolls 5 of elongate wrapper strips each having a different width suitable for wrapping a particular demonination or number of coins are supported by their respective magazines 700 arranged in substantially annular configuration. Any one of the wrapper rolls which has been selected in accordance with the denomination or number of coins to be enclosed in a single package is transported as indicated by the arrow 701 in FIG. 16 and is held in a position 702 for supplying the wrapper to the coin wrapping mechanism 4.

A rail 703 of substantially annular configuration is mounted vertically, and a plurality of (eight in this particular embodiment of the invention) magazine carriages 705 are mounted on this rail 703 so as to be movable therealong via wheels 704 engaging the rail both externally and internally. All the magazine carriages 705 are flexibly interconnected at equal spacings by links 706, thereby constituting as a whole a wrapper magazine transport mechanism generally designated by the numeral 707 in FIG. 16.

Each of the links 706 has a recess 708 in its outer edge for receiving a retainer pin 709. As illustrated in more detail in FIG. 17, the recess is defined by an edge 710 disposed approximately at right angles with the outer edge of the link 706 and by another edge 711 disposed at an obtuse angle with the outer edge of the link. The movement of the entire wrapper magazine transport mechanism 707 is arrested when the retainer pin 709 is engaged by the edge 710 of any of the recesses 708.

As also seen in FIG. 17, the retainer pin 709 is mounted adjacent one end of a lever 712 which is swingably supported at the other end thereof. This other end of the lever 712 is coupled via link 715 and bell crank 714 to the plunger actuated by a solenoid 713. Hence, upon energization of the solenoid 713, the bell crank 714 is turned clockwise, as viewed in FIG. 17, to cause the retainer pin 709 to escape from within the recess 708. When the solenoid 713 is not energized, the bell crank 714 is turned counterclockwise by a helical tension spring 717 connected to the solenoid plunger, so that the retainer pin 709 is carried to a position for engagement with the recess 708. A microswitch 716 is adapted to be actuated by the bell crank 714 when the retainer pin 709 rides on the edge 711 of the recess 708.

Referring back to FIG. 16, each of the magazine carriages 705 has a pair of parallel spaced mounting grooves 718 in opposed relationship to each other and generally arranged across the adjacent links 706. Slidingly received in these mounting grooves 718 of each magazine carriage 705 is a projection 720 formed on one end of a base 719 of the wrapper magazine 700. A bore 722 is formed through each magazine carriage 705 for receiving a locking pin 721 extending through the wrapper magazine projection 720. An endless chain 723 adapted to be driven by a third motor $M_3$ is arranged inside the annular rail 703, and a pawl 724 for engaging one of the flights of the endless chain 723 extends inwardly from each of the magazine carriages 705, so that, upon rotation of the third motor $M_3$, all the wrapper magazines 700 are moved simultaneously along the rail 703 in the direction of the arrow 701.

A plurality of microswitches $RS_1$ to $RS_8$ corresponding to the respective wrapper magazines 700 are arranged in a horizontal row, in such positions that each microswitch will be actuated by the corresponding wrapper magazine when the same is transported to the aforesaid position 702. To this end, each wrapper magazine is provided with a switch actuator member 725, FIG. 18, in a position capable of actuating the corresponding microswitch.

There is mounted on the base 719 of each wrapper magazine 700 a core pin 726 to be received in the axial opening 5*a* of the wrapper roll 5. Also mounted on the base 719 adjacent the core pin 726 is a rotatable rod 727 having an offset arm 728, and a core pin 729 is pivotally coupled to the tip of the offset arm 728 so as to be vertically swingable to be moved into and out of the axial opening 5*a* of the wrapper roll 5.

A pair of wrapper feed rolls 730 and 731 driven from the coin wrapping mechanism 4 are mounted vertically adjacent one end of the magazine base 719. A wrapper guide 732 is mounted next to the feed rolls 730 and 731, and in oposed relationship to this wrapper guide 732 there is mounted a cutter blade 733 having a V-shaped, sawtooth cutting edge. When the strip of wrapper, unwound from its roll 5, is tensioned by means later to be described, the cutter blade 733 cuts the wrapper strip into a length suitable for wrapping a single stack of coins.

Although not shown in the drawings, it is assumed that the rolls 730 and 731 are caused to rotate by a drive roll swingably supported adjacent the position 702 so as to be driven by the same drive mechanism as the wrapping rolls 20 to 22. The unshown drive roll is swung into frictional circumferential contact with the roll 730 as the latter is located in the position 702, thereby simultaneously causing the rolls 730 and 731 to rotate when the wrapper strip is to be fed toward the coin wrapping mechanism 4. The speed of rotation of the rolls 730 and 731 is subject to change in step with the wrapping rolls 20 to 22 because the wrapping rolls are caused to rotate at a variable speed in accordance with the diameter of coins to be packaged, as described hereinafter in more detail.

It should be noted that the cutter blade 733 is fixedly mounted on the base 719 of each wrapper magazine 700. Furthermore, since the wrapper roll carried by each magazine must be cut into a length depending upon the diameter of the coins to be wrapped by thereby, it is necessary that the cutter blade on each wrapper magazine be so positioned that the distance between the cutter blade and wrapper tensioning means to be described later will correspond exactly to the length into which the wrapper roll is to be cut.

Figure 18:
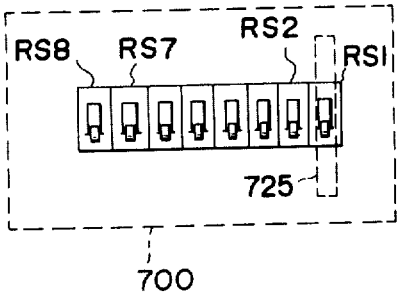
FIG. 18 is a view for explaining the relative positions of a row of microswitches and a switch actuator member of each wrapper magazine in the wrapper feed mechanism of FIG. 16.
Figure 19:
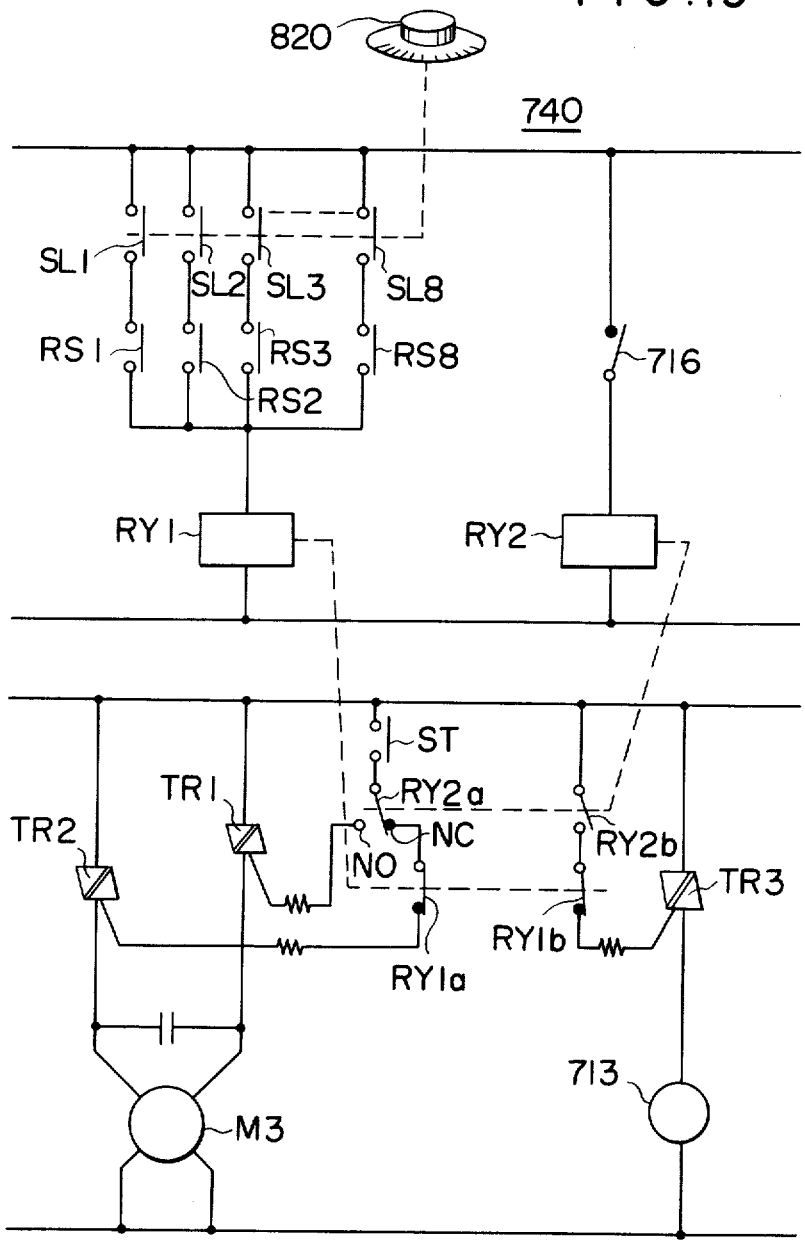
FIG. 19 is a schematic electrical diagram of control circuitry for the wrapper feed mechanism of FIGS. 16 and 17.

The electrical control circuitry for the wrapper feed mechanism of FIGS. 16, 17, and 18 is illustrated in FIG. 19. The row of microswitches $RS_1$ through $RS_8$ previously set forth in connection with FIGS. 16 and 18 are connected to the mentioned knob 820 via coin selector switches $SL_1$ through $SL_8$, respectively, which represent the denominations of the coins to be packaged by the wrapper rolls accommodated in the wrapper magazines 700 corresponding to the respective microswitches $RS_1$ through $RS_8$. The coin selector switches $SL_1$ through $SL_8$ may be, for example, in the form of a rotary switch, such that any of the coin selector switches will be closed automatically when the knob 820 is turned to a particular angular position representative of the denomination of coins corresponding to the coin selector switch. It will therefore be understood that a relay 1 is energized when the wrapper magazine 700 which is located in the position 702 in the magazine transport mechanism 707 of FIG. 16 is the one exactly corresponding to the denomination of the coins which has been selected by the knob 820 for the ensuing packaging operation.

The microswitch 716 previously described with reference to FIG. 17 is a normally closed type such that a relay $RY_2$ is deenergized when the retainer pin 709 rides on the edge 711 of any of the recesses 708. The relays $RY_1$ and $RY_2$ are adapted to control the operations of the third motor $M_3$ and the solenoid 713. A bidirectional controlled rectifier $TR_1$ for causing the forward rotation of the third motor $M_3$ has its gate connected to the normally open contact NO of the contact set $RY_{2a}$ of the relay $RY_2$ serially connected to a motor-starting contact pair ST. A bidirectional controlled rectifier $TR_2$ for causing reverse rotation of the third motor $M_3$ has its gate connected to the normally closed contact NC of the relay contact set $RY_{2a}$ via the normally closed contact pair $RY_{1a}$ of the relay $RY_1$. A bidirectional controlled rectifier $TR_3$ for the operation of the solenoid 713 has its gate connected to the normally closed contact pair $RY_{1b}$ of the relay $RY_1$ and thence to the normally open contact pair $RY_{2b}$ of the relay $RY_2$.

It will now be assumed that, in the circuit configuration described above, the third wrapper magazine is located in the position 702 of FIG. 16 and that the retainer pin 709 is engaged by the edge 710 of the recess 708 in the adjacent link 706 as illustrated in FIG.

20A. If then, the knob 820 is manually turned to a position corresponding to another denomination of coins which require a wrapper roll held by, say, the first wrapper magazine, with the resultant closure of the coin selector switch $SL_1$, the relay $RY_1$ will become deenergized to close its contact pair $RY_{1a}$ because the denomination of coins corresponding to the wrapper magazine which has been located in the position 702 disagrees with the newly selected denomination of coins. Since the retainer pin 709 is now received in the recess 708 as aforesaid, the microswitch 716 is opened, so that the movable contact of the contact set $RY_{2a}$ of the unenergized relay $RY_2$ is closed against the contact NC. Hence, upon closure of the motor-starting contact pair ST, the bidirectional controlled rectifier $TR_2$ becomes conductive to initiate the rotation of the motor $M_3$ in the reverse direction. The wrapper magazines 700 are thus moved in the direction opposite to the direction of the arrow 701 of FIG. 16.

Figure 20:
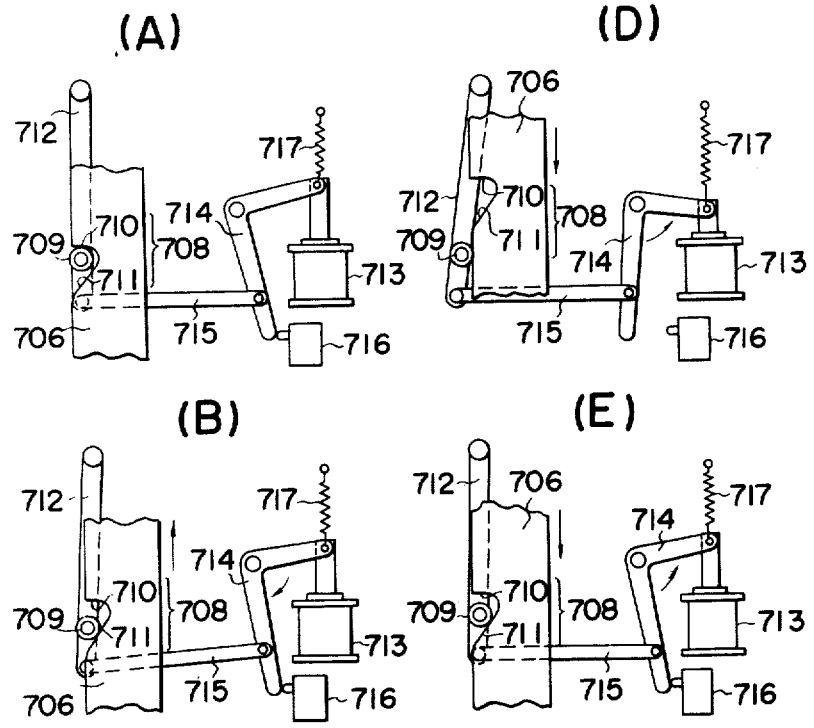
FIGS. 20A to 20E inclusive are views sequentially illustrating the operating steps of the locking means of FIG. 17.

As seen in FIG. 20B, the retainer pin 709 slides over the edge 711 of the recess 708 as the wrapper magazines move in the direction indicated by the arrow in this drawing, thereby causing the clockwise rotation of the bell crank 714 out of abutment against the microswitch 716. With the microswitch 716 thus closed, the relay $RY_2$ is energized to close its contact pair $RY_{2b}$. The solenoid 713 is now energized to cause the bell crank 714 to further turn clockwise as shown in FIG. 20C, so that the retainer pin 709 is completely released from within the recess 708. Simultaneously, the movable contact of the relay contact set $RY_{2a}$ becomes switched over to the contact NO, thereby initiating conduction through the bidirectional controlled rectifier $TR_1$. By the resulting rotation of the third motor $M_3$ in its forward direction, the wrapper magazines are transported in the direction of the arrow 701 along the rail 703 by the magazine transport mechanism 707. This magazine transportation is maintained until the first wrapper magazine reaches the position 702 and closes the corresponding microswitch $RS_1$.

The microswitch $RS_1$becomes closed when the first wrapper magazine comes sufficiently close to the position 702. Since now the denomination of coins corresponding to the wrapper magazine in the position 702 agrees with the denomination of coins corresponding to the position of the knob 820, the relay $RY_1$ becomes energized. The relay contact pair $RY_{1b}$ is thus opened to deenergize the solenoid 713, as represented in FIG. 20D. As a consequence, the bell crank 714 is turned counterclockwise by the influence of the helical tension spring 717, so that the retainer pin 709 is moved toward the link 706.

It should be noted that the deenergization of the solenoid 713 is so timed that the retainer pin 709 will abut the link 706 at a point slightly below the recess 708, as seen in FIG. 20D. This timing of solenoid deenergization can be realised by suitably determining the position and size of the actuating member 725, FIG. 18, of each wrapper magazine 700 in relation to the positions of the microswitches $RS_1$ to $RS_8$.

The forward rotation of the third motor $M_3$ is thus maintained even after the retainer pin 709 has moved into contact with the link 706. With the continued downward travel of the link 706, therefore, the retainer pin 709 slides into the recess 708 along its edge 711, as shown in FIG. 20E. The bell crank 714 is gradually turned counterclockwise as the retainer pin 709 slides into the recess 708 in the above described manner, until at last the microswitch 716 is opened by the lower end of the bell crank. Since then the relay $RY_2$ of FIG. 17 becomes deenergized, the movable contact of its contact set $RY_{2a}$ becomes switched over to the contact NC, while its contact pair $RY_{2b}$ becomes opened. The contact pairs $RY_{1a}$ and $RY_{1b}$ of the other relay $RY_1$ are now both already opened, so that the third motor $M_3$ is caused to terminate its rotation, while the solenoid 713 is held inoperative.

Since the magazine transport mechanism 707 carries several wrapper magazines of considerable weight, there inevitably takes place some inertial rotation, so that the retainer pin 709 further slides along the edge 711 of the recess 708. The inertial rotation of the magazine transport mechanism 707 is forcibly arrested when the retainer pin abuts against the edge 710 of the recess 708. It will therefore be appreciated that the magazine transport mechanism 707 can be locked in position by the retainer pin 709 received in the recess 708 in its deepest position. For unlocking the magazine transport mechanism 707 from its stationary position, the mechanism is temporarily revolved in the reverse direction as previously mentioned, thereby causing the retainer pin 709 to move away from the edge 710 of the recess 708 and to escape from within the recess in sliding contact with the other edge 711. This unlocking method permits the use of a relatively small-output motor for driving the magazine transport mechanism 707.

Alternatively, there may be contemplated the employment of the solenoid 713 for shifting the retainer pin 709 from its deepest position within the recess 708 directly to its outermost position shown in FIG. 20C. This unlocking method is disadvantageous, however, because then the solenoid must be of sufficiently large capacity to overcome the force with which the retainer pin is urged against the edge 710 of the recess 708 to securely lock the magazine transport mechanism 707 in position. Since the microswitches $RS_1$ to $RS_8$ are selectively actuated by the respective wrapper magazines 700 transported to the position 702 according to the configuration shown in FIG. 16, any desired one of the wrapper rolls 5 can be properly transported to and retained in position if the positions of the wrapper magazines 700 are interchanged on the carriages 705. It is of course possible for the edge 710 of each recess 708 to be arranged at an acute angle to the outer edge of the link 706 in order to ensure still more positive locking of the magazine transport mechanism 707 by the retainer pin 709.

Figure 21:
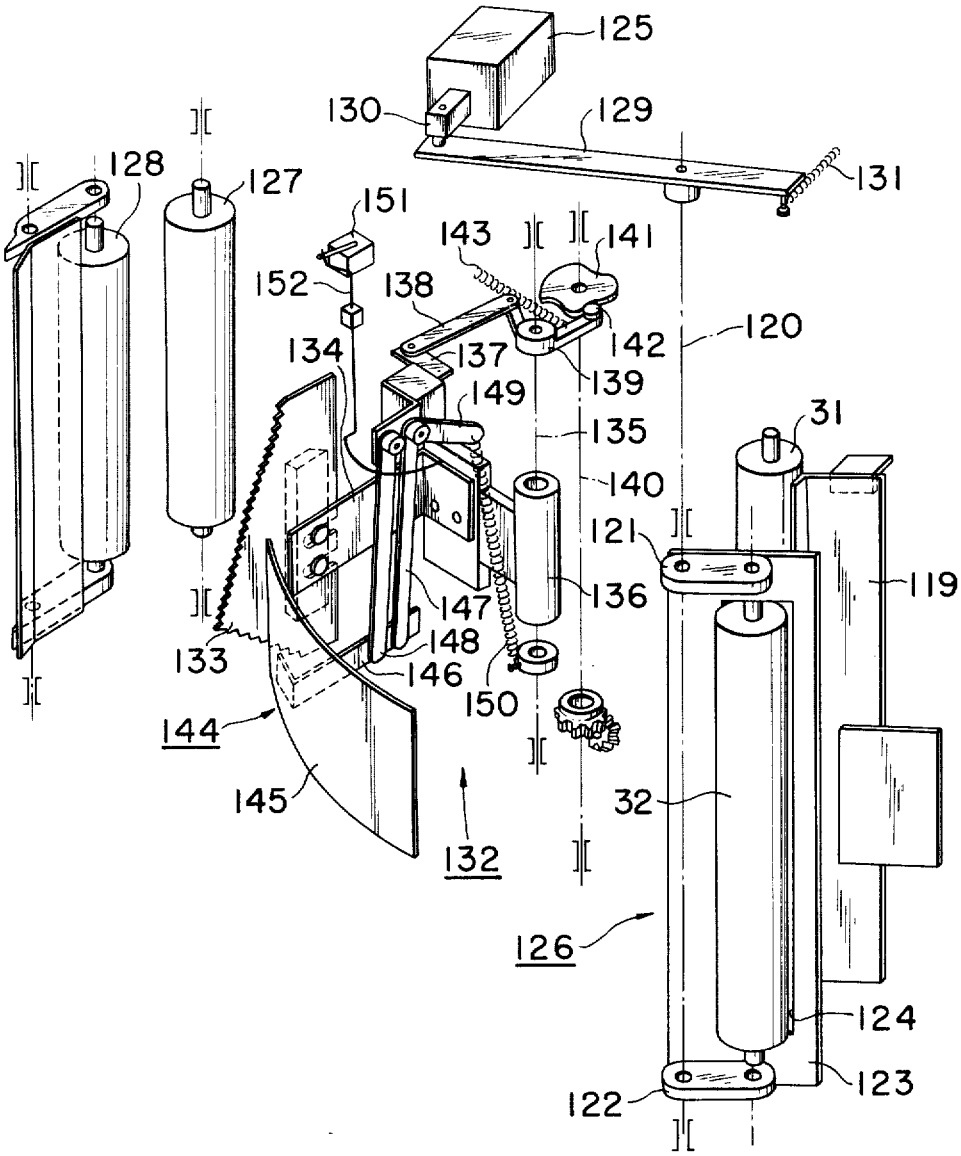
FIG. 21 is an exploded perspective view of wrapper tensioning means and wrapper sensing means.

FIG. 21 illustrates a wrapper tensioning means 126 constituting a part of the wrapper feed mechanism 7. The wrapper tensioning means 126 comprises the pair of drive roll 31 and idler roll 32 briefly described in conjunction with FIg. 10. The idler roll 32 is movable into and out of circumferential contact with the drive roll 31 by means including a solenoid 126. The strip of wrapper to be tensioned is fed from its roll 5 to the drive and idler rolls 31 and 32 via the feed rolls 127 and 128 rotatably supported adjacent the wrapper roll. It is to be noted that this wrapper tensioning means 126 is located between a wrapper sensing means 144, to be described later, and the coin wrapping mechanism 4.

As previously mentioned, the arms 121 and 122 rotatably supporting the idler roll 32 are fixedly mounted on the rotary shaft 120. A swingable link 129 also fixedly mounted on this rotary shaft 120 has one of its ends pivotally coupled to the plunger 130 of the solenoid 125. Connected to the other end of the swingable link 129 is a helical tension spring 131 which exerts a force tending to urge the idler roll 32 into circumferential contact with the drive roll 31. Although not shown in the drawing, it is assumed that the solenoid 125 is actuated upon closure of its switch by a cam mounted on the shaft 48 shown in FIG. 10. When thus energized, the solenoid 125 will cause the idler roll 32 to move out of circumferential contact with the drive roll 31 against the force of the spring 131.

FIG. 21 also illustrates a cutter means 132 which is of the type to be employed in coin packaging apparatus of the fixed wrapper roll type, as distinguished from the apparatus of selectable wrapper roll type previously described in connection with FIG. 16 in particular. In the apparatus of fixed wrapper roll type now under consideration, a roll of wrapper strip required for each denomination of coins to be packaged is manually installed in position within the apparatus. Thus, the feed rolls 127 and 128 in the arrangement of FIG. 21 corresponding to the rolls 730 and 731 in the arrangement of FIG. 16, whereas the wrapper tensioning means 126 and the wrapper sensing means 144 are employable in both types of apparatus. However, in the apparatus of selectable wrapper roll type, the wrapper sensing means 144 may be mounted either on a stationary frame member or on each of the wrapper magazines 700. If the wrapper sensing means 144 is mounted on each wrapper magazine 700 in the apparatus of selectable roll type, then its sensing plate 145 need not be shifted in position in accordance with each denomination of coins to be packaged but should only be slightly displaced to actuate a switch 151 when the wrapper strip is properly tensed by the wrapper tensioning means 126.

Referring again to FIG. 21, the cutter means 132 adapted to be incorporated in the apparatus of fixed wrapper roll type includes a cutter blade 133 also having a V-shaped, sawtooth cutting edge and mounted on a support 134. This blade support 134 is carried by a sleeve 136 fixedly mounted on a rotatable shaft 135. A member 137 also carried by the sleeve 136 is pivotally coupled to a link 138 and thence to a lever 39 on the rotary shaft 135. Rotatably mounted on the free end of the lever 139 is a cam follower roll 142 which is urged by a helical tension spring 143 into abutment with a cam 141 fixedly mounted on a shaft 140 capable of rotation in step with the shaft 36 shown in FIG. 10.

The wrapper sensing means 144, located between the cutter blade 133 and the tensioning rolls 31 and 32, includes an arcuate sensing plate 145 extending along the path of travel of the wrapper strip. The sensing plate 145 is fixedly supported on its back by a support 146 which in turn is pivotally supported via a pair of swingable links 147 and 148 arranged substantially parallel to the sleeve 136. The link 147 has an offset arm 149 connected to a helical tension spring 150 which energizes the sensing plate 145 forwardly, that is, toward the path of travel of the wrapper strip. The link 147 is further engaged by the tip of a swingable lever 152 adapted to actuate the switch 151.

It should be noted that in the event the sensing plate 145 is not actuated by the wrapper strip in previously timed relationship with the operation of the coin wrapping mechanism 4, then the seitch 151 is held open. As a consequence, the rotation of the shaft 48 (FIG. 10) terminates, and the wrapping rolls 20, 21, and 22 of the coin wrapping mechanism continue rotating while holding a stack of coins therebetween. The coin wrapping mechanism 4 is thus held standing by, being prevented from proceeding to the next step of coin processing. When the sensing plate 145 is then actuated by the belatedly supplied wrapper strip, the rotation of the shaft 48 is resumed, thereby permitting the coin wrapping mechanism to proceed to the next processing step. However, unless the wrapper strip is supplied within a preassigned length of time following the initiation of the standby condition of the coin wrapping mechanism, the rotation of the second motor $M_2$ also terminates, with the resultant termination of the rotations of the wrapping rolls 20, 21, and 22 and the drive roll 31.

According to the configuration of FIG. 21, the shaft 140 rotates in step with the shaft 36 carrying the knob 820 shown for example in FIG. 10, in order to adjustably vary the angular position of the cutter blade 133 in such a manner that the wrapper strip will be thereby cut into a length corresponding to the diameter of the coins to be packaged. It will be apparent that if the position of the cutter blade 133 is made adjustable in the transverse direction of the wrapper strip extending therepast, the pointed tip of the V-shaped cutter blade edge can always be aligned with the central longitudinal axis of each of several wrapper strips of different width which may be used in the coin packaging apparatus of the type incorporating the mechanism of FIG. 16. Such an arrangement is advisable for efficiently cutting wrapper strips of different width by the single cutter blade.

Figure 22:
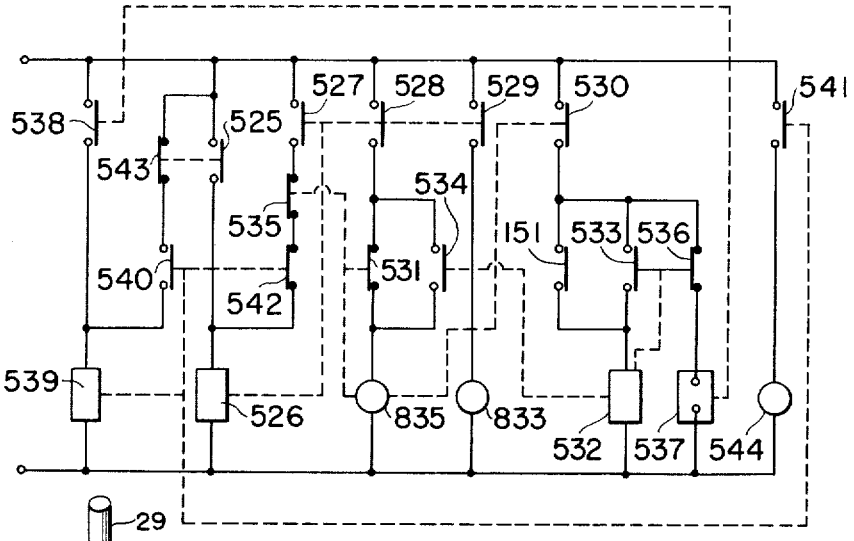
FIG. 22 is a schematic electrical diagram of control circuitry for the wrapping mechanism which is actuated by the wrapper sensing means of FIG. 21.

FIG. 22 illustrates an example of electrical circuitry that may be employed for realizing the desired operation of the above described mechanism. A switch 525 is closed when a predetermined number of coins are counted, resulting in the energization of a relay 526. The contact pairs 527, 528 and 529 are closed upon energization of the relay 526. The relay 526 is held energized via the closed contact pair 527. By the closure of the other two relay contacts 528 and 529, the clutch 835 becomes operative to drive the shaft 48 (FIG. 10), and the second motor $M_2$ also becomes operative to drive the drive roll 31 and the wrapping rolls 20 and 21. Upon rotation of the shaft 48, a switch 530 is closed, while a switch 531 is opened.

When the wrapper strip is sensed by the sensing plate 145, the switch 151 is closed as aforesaid, thereby energizing a relay 532 to close its contact pairs 533 and 534. The relay 532 is held energized via its closed contact pair 533, and the clutch 835 is held operative via the closed contact pair 534, so that the coin wrapping operation is continued. Upon completion of this wrapping operation, a switch 535 is opened by the cam on the shaft 48 to switch the second motor $M_2$ and clutch 833 out of operation.

In the event the succeeding wrapper strip is not supplied within the preassigned length of time, the switch 151 is held open as aforesaid. Since the relay contact pair 534 and switch 531 are both open, the clutch 835 becomes disengaged thereby terminating the rotation of the shaft 48. The coin wrapping mechanism 4 is thus set in the above described standby condition in which the second motor $M_2$ is kept in rotation to maintain the rotations of the wrapping rolls 20 to 22 in frictional circumferential contact with the stack of coins supported therebetween. The drive roll 31 is also kept in rotation.

The switch 151 is closed when the wrapper strip is supplied during the standby condition of the coin wrapping mechanism 4. The clutch 835 becomes operative again to permit a suitable length of wrapper strip, severed from the continuous strip by the cutter means 132 shown in FIG. 21, to be wrapped around the circumference of the stack of coins by the wrapping rolls 20 to 22. However, in the event the wrapper strip is not supplied in, say, ten seconds following the initiation of the standby condition of the coin wrapping mechanism 4, a contact pair 536 interlocked with the relay contact pair 533 will be held closed because then the relay 532 is not energized, so that a time-delay relay 537 operates to close its contact pair 538. Upon the resulting energization of a relay 539, its contact pairs 540 and 541 are both closed, and the contact pair 542 is opened. Since now a switch 543 interlocked with the switch 525 is closed, the relay 539 can be held energized via its closed contact pair 540. A lamp 544 is thus lit to indicate visually the fact that the wrapping strip is not being supplied properly. The relay 526 is deenergized upon opening of the contact pair 542, thereby opening its contact pairs 527 to 529. The clutch 833 is disconnected to stop the rotations of the wrapping rolls 20, 21, and 22. The rotation of the drive roll 31 also stops.

COIN GUIDE MECHANISM

Figure 23:
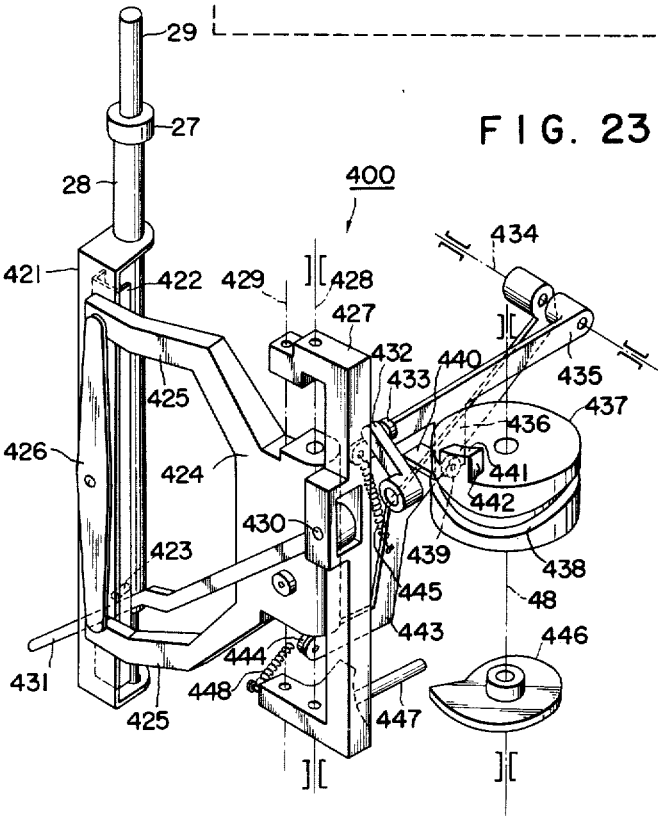
FIG. 23 is a perspective view showing a coin guide mechanism in the apparatus of FIG. 1.

The coin guide mechanism generally designated by reference numeral 400 in FIG. 23 includes a hollow guide rod 28 having a flanged top 27 for supporting a stack of coins thereon. The guide rod 28 is slidably fitted over a support rod 29 supported vertically by a support frame 421, in such a manner that the guide rod is movable up and down while being guided by the support rod. The support frame 421 includes a vertically extending guide groove 422 adapted to slidably receive a projection 423 formed on the bottom end of the guide rod 28. The support frame 421 is supported at the tips of a pair of arms 425 of a carriage via a member 426.

The carriage 424 is swingably mounted on a shaft 428 on which there is also swingably mounted a substantially U-shaped member 427. Another shaft 429 extends through both of the U-shaped member 427 and the carriage 424, so that the carriage is swingably simultaneously with the U-shaped member. A rod 431 is pivotally supported at 430 on the U-shaped member 427 and has its free end in abutting engagement with the projection 423 on the bottom end of the guide rod 28. The rotatable shaft 430 on which the rod 431 is fixedly mounted extends transversely through the U-shaped member 427 and is rigidly coupled to a crank 432 rotatably supporting a cam frollower roll 433.

A lever 435 mounted on a rotatable shaft 434 at one end thereof has its other end in abutting engagement with the free end of the crank 432. A lever 435 includes a lateral projection 436 rotatably supporting a cam follower roll 439 movably received in a circumferential groove 438 of a cam 437 fixedly mounted on the shaft 48. The cam groove 438 is so contoured that the guide rod 28 will move rapidly during its upward stroke and slowly during its downward stroke. The lateral projection 436 of the lever 435 is provided with a bent portion 440 for purposes hereinafter made apparent.

The cam 437 has on its top a projection 442 having a slightly sloping face 441 adapted for abutting engagement with the cam follower roll 433 on the crank 432. The cam face 441 cooperates with the crank 432 for slowing down the movement of the guide rod 28 at the instant when the stack of coins is shifted from the flanged top 27 of the guide rod to the top of the support rod 29. Another lever 443 swingably mounted on the rotatable shaft 434 rotatably supports a roll 444 on its free end which roll is adapted for abutting engagement with the bottom edge of the carriage 424. The levers 435 and 443 are urged toward each other by a helical tension spring 445 but are retained in different angular positions on the rotatable shaft 434 by the aforesaid bent portion 440 of the former which rests on the upper edge of the latter.

The U-shaped member 427 carries a cam follower pin 447 projecting laterally from its bottom end for abutting engagement with the circumference of a cam 446 which is also mounted on the shaft 48. The cam follower pin 447 is yieldably urged against the circumference of the cam 446 by a helical tension spring 448 extending between the U-shaped member 427 and a stationary part, not shown, of the apparatus.

ADJUSTING MECHANISM

Since coins to be packaged by this apparatus change in both diameter and thickness according to their denominations, it is necessary to vary the spacing between the rotary disc 13 and the wall member 15, the width of the coin passage 17, the height of the endless belt 18 with respect to the passageway 17, the inside diameter of the stacking cylinder 200, the position of the wrapper guide 99 relative to the stack of coins supported in position between the wrapping rolls 20 to 22, and the spacing between the crimping hooks 23 and 24 (or the position of the upper arm 144 relative to the lower arm 145), in accordance with the denomination or the number of coins to be enclosed in each package. All such adjustments can be performed by the adjusting mechanism schematically illustrated in FIG. 24.

As seen in the drawing, a rotary switch 821 is adapted to be operated by the shaft 800 carrying the knob 820 on its top. The rotary switch 821 comprises a plurality of, eight in this embodiment of the invention, annularly spaced fixed contacts corresponding to the respective denominations of coins to be handled by the apparatus. Formed correspondingly along the circumference of the knob 820 are calibrations $n_1$, $n_2$ ... $n_8$ which also represent the respective denominations of coins. Any desired denomination of coins to be packaged by the apparatus can be manually selected by adjusting the corresponding calibration to an index 822, thereby causing the movable contact of the rotary switch 821 to be closed to the corresponding one of its fixed contacts $n_1$ to $n_8$. The knob 820 and the shaft 800 are indicated by the dot-and-dash lines in FIG. 1.

Another rotary switch 823 is provided which also comprises eight annularly spaced fixed contacts and which is adapted to be operated by a rotatable shaft 827 operatively coupled to the output shaft 824 of the second motor $M_2$ via electromagnetic clutch 825 and gear train 826. Thus, when the shaft 827 is rotated by the second motor $M_2$, the rotary switch 823 produces an electrical output in accordance with the angular position of the shaft 827.

The electrical outputs from the rotary switches 821 and 823 are both delivered to a coincidence detector circuit 829 provided within a control section 828. Upon agreement of the output signals from the respective rotary switches, the coincidence detector circuit 829 delivers its output to a drive circuit 831 for the electromagnetic clutch 825 which is under the control of a main control circuit 830, in order to terminate its operation. Thus, if the knob 820 is manually turned and adjusted to the position of, say, the calibration $n_1$ while the shaft 827 is in an angular position corresponding to, say, the calibration $n_4$, then the rotary switches 821 and 823 will deliver their output signals from their first and fourth fixed contacts, respectively, to the coincidence detector circuit 829. The electromagnetic clutch 825 is then allowed by the main control circuit 830 to continue transmitting the rotation of the second motor $M_2$ to the shaft 827, until the shaft 827 assumes such an angular position that the rotary switch 823 produces an output from its first fixed contact. In this manner, the shaft 827 is caused to assume the exact angular position corresponding to the denomination of coins precedingly selected by the knob 820.

By taking advantage of the above described fact that the shaft 827 is angularly positioned in exact conformity with the angular position precedingly occupied by the shaft 800, cams means are provided which are actuated by these shafts 800 and 827 for performing the various adjustments listed previously. The shaft 800 is provided with first cam means $K_1$ for adjusting the spacing between the rotary disc 13 and the wall member 15, second cam means $K_2$ for adjusting the height of the endless belt 18 with respect to the passageway 17, and third cam means $K_3$ for adjusting the width of the passageway 17. All these cam means $K_1$, $K_2$, and $K_3$ are required to operate either when the apparatus is set to perform the entire coin packaging operation or only the coin counting operation by the aforesaid operation selector mechanism 3.

On the other hand, the following cam means for the shaft 827 are intended for use only when the apparatus is set to perform the coin packaging operation. These cam means include fourth cam means $K_4$ for adjusting the inside diameter of the stacking cylinder 200, fifth cam means $K_5$ for adjusting the relative positions of the wrapping rolls 20 to 22, sixth cam means $K_6$ for adjusting the position of the wrapper guide 99 relative to the stack of coins supported in position between the wrapping rolls, and seventh cam means $K_7$ for adjusting the spacing between the crimping hooks 23 and 24, as herein after described in more detail.

The first and second cam means $K_1$ and $K_2$ adjustably vary the vertical positions of the wall member 15 and the endless belt 18 relative to the rotary disc 13 and the passageway 17, respectively, in accordance with the thickness of each of the coins of a particular denomination represented by the angular position assumed by the knob 820. The coins of the particular denomination can thus be smoothly fed into and out of the passageway 17 one by one.

The third cam means $K_3$ is adapted to adjust the position of the movable member 186 defining one of the lateral edges of the passageway 17 relative to the stationary member 184 defining the other lateral edge of the passageway, in order that the passageway may have a width conforming to the diameter of the coins of the selected denomination. It is possible in this manner to feed the coins of the selected denomination along the passageway 17 in a neat row. Coins thicker than the coins of the selected denomination, if any, can be eliminated as they are caught between the rotary disc 13 and the wall member 15, while coins smaller in diameter (and usually less thick) than the coins of the selected denomination can be eliminated by coin discriminating means, not shown, provided across the passageway 17. Thus, even though some coins of other than the selected denomination may be contained in each batch of coins charged into the hopper 11, FIG. 1, all such undesired coins are successfully detected and eliminated before they can be packaged or counted.

The fourth cam means $K_4$ operates to adjustably vary the relative positions of the constituent plate members 201 of the stacking cylinder 200 so that its inside diameter will be only slightly greater than the diameter of the coins of the selected denomination. Thus, although there may be some coins which stand on their circumferential edges as they drop into the stacking cylinder 200, such coins will immediately assume a horizontal disposition and will be properly stacked one upon the other as vibrations are imparted to the stacking cylinder.

The fifth cam means $K_5$ is effective to adjust, in accordance with the diameter of coins to be packaged, the distance the wrapping rolls 20 to 22 are caused to move from their variable intermediate position toward the central axis therebetween, so that the wrapping rolls will each be located a prescribed minimum distance from the circumference of the stack of coins to be carried succeedingly from the stacking cylinder 200 down to the central position therebetween by the guide rod 27, FIG. 23. As a consequence, the wrapping rolls 20 to 22 perform the function of guide walls as the stack of coins is carried down to the central position therebetween, thereby preventing the coin stack from collapsing during its travel from the coin stacking mechanism 2 to the coin wrapping mechanism 4.

The sixth cam means $K_6$ is adapted to adjustably vary the operative position of the wrapper guide 99 in accordance with the diameter of the coins of the selected denomination. The wrapper guide 99 in its adjusted operative position will cooperate with the wrapping rolls 20 to 22 so that the wrapper strip will be correctly wound around the circumference of the stack of coins as this coin stack rotates in frictional contact with the wrapping rolls.

The seventh cam means $K_7$ operates to adjustably vary the vertical position of the arm 144 carrying the upper crimping hook 23, FIG. 10, with respect to the other arm 145 so that the upper crimping hook will be located slightly above the top of the stack of coins when this coin stack is supported in position between the wrapping rolls 20 to 22. The upper and lower crimping hooks 23 and 24 are thus enabled to properly fold and crimp the lateral edges of the wrapper strip, which has been previously wound around the circumference of the coin stack, over its top and bottom ends.

It should be noted that the desired operations of the above described cam means $K_1$ through $K_7$ and of the rotary switch 823 are effected by the second motor $M_2$, which essentially is provided to drive the coin wrapping mechanism and/or the coin counting mechanism. In order to derive the output torque from the second motor $M_2$ necessary for driving these mechanisms, the output shaft of the second motor is further connected via gear train 832 and electromagnetic clutch 833 to a shaft 834 for driving the wrapping rolls 20, 21, and 22 and the wrapper tensioning rolls 31 and 32 and, via another electromagnetic clutch 835, to a shaft 836 for driving the shaft 48 and the means for imparting vibrations to the stacking cylinder 200. These two electromagnetic clutches 823 and 835 are actuated by their respective drive circuits 837 and 838 under the control of the main control circuit 830 after the coincidence detector circuit 829 has produced its output upon agreement of the output signals from the rotary switches 821 and 823. In this manner, the rotation of the second motor $M_2$ is utilized for the adjustment of the above listed various working components of the coin packaging apparatus before initation of its actual coin packaging or counting operation and, upon completion of the preliminary adjustment, for driving the coin wrapping mechanism and/or the coin counting mechanism.

It is desirable, in the coin packing apparatus of this type, that the peripheral speed of each stack of coins being rotated in frictional contact with the wrapping rolls 20 to 22 to wind the wrapper strip around its circumference be made substantially constant regardless of a change in coin diameter. To this end, speed change means 839 and 840 are provided for the shaft 834 adapted to drive the wrapping rolls 20, 21, and 22 and the wrapper tensioning rolls 31 and 32 and for the shaft 836 adapted to drive the shaft 48, respectively. Eighth cam means $K_8$ provided for the shaft 827 is adapted to operate the speed change means 839 and 840 so as to adjustably vary the speed of rotation of the second motor $M_2$ in accordance with the diameter of the coins to be packaged.

It will also be understood that if the revolving speed of the disc 13 and of the endless belt 18 is constant, the number of coins fed out of the passageway 17 per unit length of time will decrease with an increase in the diameter of the coins. Consequently, the revolving speed of the disc 13 and of the endless belt 18 must be appropriately varied in order that each prescribed number of coins may be fed into the stacking cylinder 200 in a constant length of time regardless of any change in coin diameter. This objective can be accomplished by providing speed change means 844 and electromagnetic clutch 843 coupled to the output shaft 841 of the first motor $M_1$, the clutch 843 being under the control of the main control circuit 830 via a drive circuit 842. Ninth cam means $K_9$ is provided for the shaft 827 to operate the speed change means 844 so as to adjustably vary the speed of rotation of the first motor $M_1$ in accordance with the diameter of the coins to be packaged.

Figure 24:
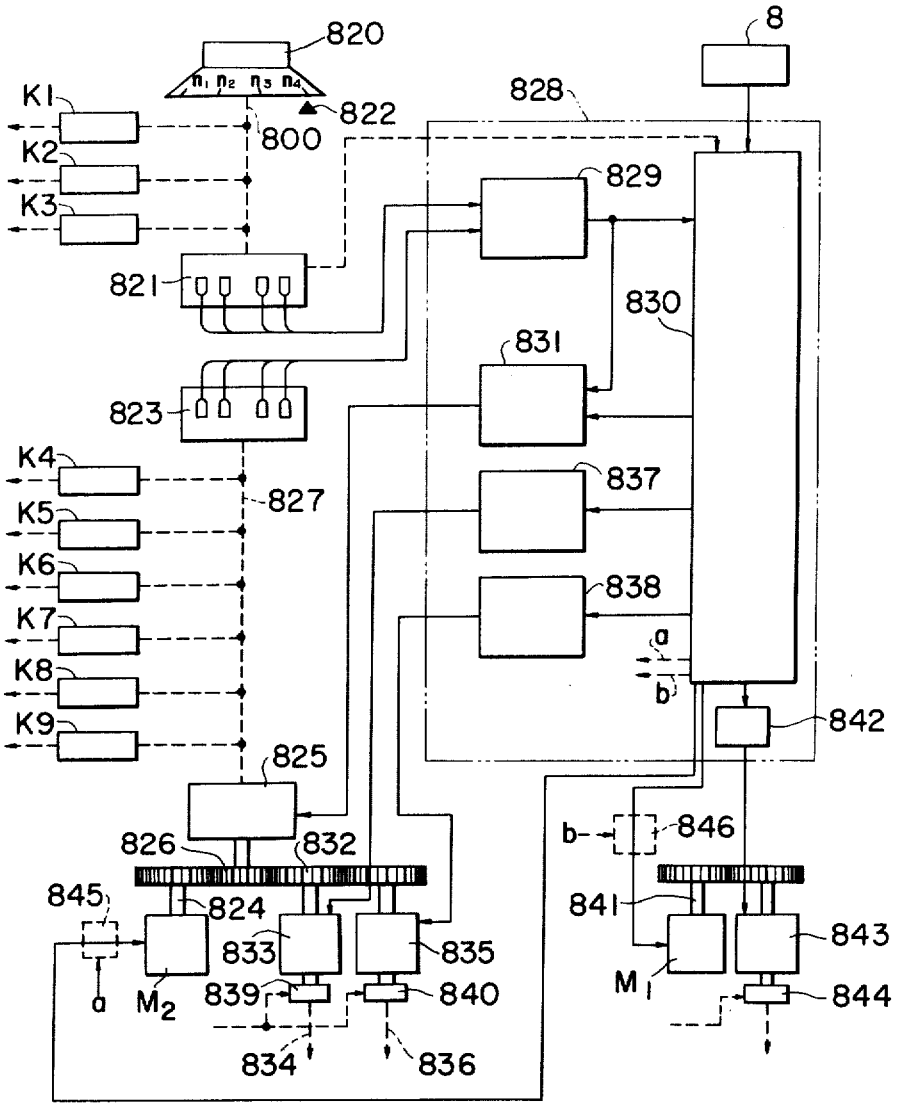
FIG. 24 is a schematic diagram for explaining means for adjusting the various working parts of the apparatus of FIG. 1 in accordance with the denomination of coins to be packaged and of means for controlling the operation of the apparatus.

Instead of the mechanical means set forth in the foregoing, the first and second motors $M_1$ and $M_2$ may be provided with electrical control circuits 846 and 845 respectively, as indicated by the dotted lines in FIG. 24, which are adapted to be controlled by signals b and a delivered from the main control circuit 830 in response to an output signal from, say, a rotary switch to be actuated in accordance with the denomination or diameter of coins to be packaged.

It is assumed that the main control circuit 830 is further supplied with the various output signals from a power switch, a starting switch, means for selecting the number of coins to be enclosed in each package, and other means forming part of the control mechanism 8. The main control circuit 830 thus functions to control the entire operation of the coin packaging apparatus.

The configurations and operations of the first through ninth cam means $K_1$ through $K_9$ are hereinafter described in greater detail in conjunction with FIG. 25. The first cam means $K_1$ includes a cam 849 rotated in step with the shaft 800 via bevel gearing 847 and 848. The spacing between the wall member 15 and the rotary disc 13 can be varied as desired via the cam follower pin 182 extending downwardly from the wall member for abutment against the cam 849.

The second cam means $K_2$ includes a cam 852 which is likewise rotated in step with the shaft 800 via bevel gearing 850 and 851 for adjusting via a cam follower pin 854 the vertical position of a mount 853 supporing the endless belt 18.

The third cam means $K_3$ includes a crown gear 855 fixedly mounted on the shaft 800 and meshing with a star wheel 856. A cam 857 is mounted on the same shaft as the star wheel 856 for simultaneous rotation therewith and is adapted for abutment directly against the movable member 186 defining one of the lateral edges of the coin passageway 17. The width of this passageway can thus be adjusted to the diameter of the coins selected by the knob 820.

The fourth cam means $K_4$ includes the cam 821 adapted to be rotated in step with the shaft 827 via bevel gearing 858 and 859. As previously set forth in connection with FIG. 7, the cam follower roll 214 on the adjusting lever 207 of the stacking cylinder 200 is spring-actuated into abutment against the cam 821. The inside diameter of the stacking cylinder 200 is thus adjustable to the diameter of the coins selected by the knob 820.

The fifth cam means $K_5$ is such that the arm 59 is turned via the bevel gearing 858 and 859 and another gearing 860, in order to determine the aforesaid intermediate positions of the wrapping rolls 20 to 22 in accordance with the diameter of the coins to be packaged, as will be seen by referring back to FIG. 10.

The sixth cam means $K_6$ includes a cam 861 adapted to be rotated via the bevel gearing 858 and 859 and gearing 860. The rotation of the cam 861 is conveyed via linkage means 862 to the wrapper guide 99 provided to the wrapping roll 21, in such a manner that the wrapper guide is turned relative to the wrapping roll so as to occupy a position predetermined in accordance with the diameter of the coins to be packaged. Hence, when the wrapping roll 21 is moved to its adjusted intermediate position, the wrapper guide 99 will be so disposed that its inside surface extends along the circumference of the stack of coins to be carried down to the central position between the wrapping rolls 20 to 22.

Figure 25:
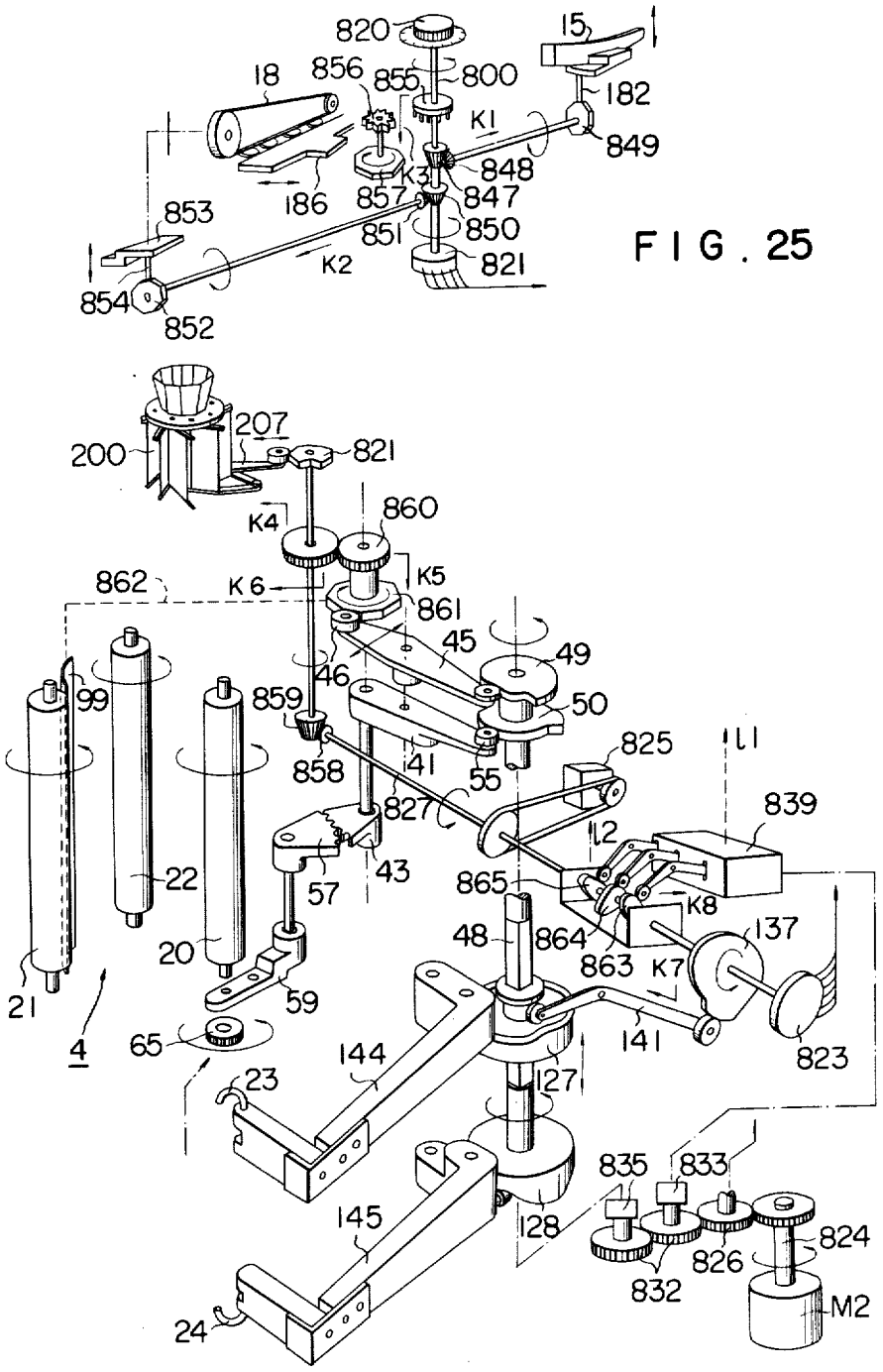
FIG. 25 is a perspective view of an explanatory nature showing in detail the configurations of various cam means in the adjusting means of FIG. 24.

As illustrated in both FIGS. 10 and 25, the seventh cam means $K_7$ includes the cam 137 mounted directly on the shaft 827 for abutting engagement with one end of the lever 141, the other end of which is operatively engaged with the cam 127 on the shaft 48. Hence, upon rotation of the cam 137, the cam 127 is movable up and down along the shaft 48 together with the arm 144 carrying the upper crimping hook 23. The upper crimping hook can thus be located only slightly above the top of the stack of coins supported in position between the wrapping rolls 20 to 22.

The eighth cam means $K_8$ comprises high-, intermediate-, and low-speed cams 863, 864, and 865 which also are mounted directly on the shaft 827, and which are adapted to operate the respective actuating levers of the speed change means 839 for adjustably varying the revolving speed of the wrapping rolls 20, 21, and 22 and of the wrapper tensioning rolls 31 and 32.

The ninth cam means, not shown in FIG. 25, is similar in configuration and operation to the above described eighth cam means $K_8$.

As can be understood from the foregoing description of FIGS. 24 and 25, it is possible according to this invention to make the necessary adjustments of the apparatus simply by manipulating the means for selecting the denomination of the coins to be packaged. It is also noteworthy that these adjustments are accomplished by use of the motor for driving the coin wrapping and counting mechanisms, so that it is unnecessary to provide an additional motor to be employed exclusively for adjustment purposes. Furthermore, since some of the cam means $K_1$ to $K_9$ are driven by the manually operated shaft 800, the motor is significantly relieved of the necessity for a high power output for driving the shaft 827 associated with the other cam means.

According to the configuration best represented in FIG. 24, the shaft 800 is required to drive the cam means $K_1$ to $K_3$ for adjustments necessary when the appartus is set to perform the coin counting operation only, whereas the shaft 827 is required to drive the cam means $K_4$ to $K_9$ for adjustments necessary when the appartus is set to perform the entire coin packaging operation. When the appartus is set to perform the coin counting operation by the operation selector mechanism 3, therefore, the cam means $K_4$ through $K_9$ can be held stationary, so that the apparatus as a whole is highly efficient and economical in operation.

Alternatively, the manually operated shaft 800 may be caused to drive those of the cam means $K_1$ to $K_9$ which will impose a greater load thereon, whereas the motor driven shaft 827 is caused to drive the other cam means which will impose less load. It is possible in this manner to further reduce the overall load on the motor $M_2$. Of course, the manually operated shaft 800 can be caused to drive those cam means which will impose less load, and the motor driven shaft 827 to drive the other cam means which will impose a greater load, thereby making easier the manual turning of the knob 820.

Figure 26:
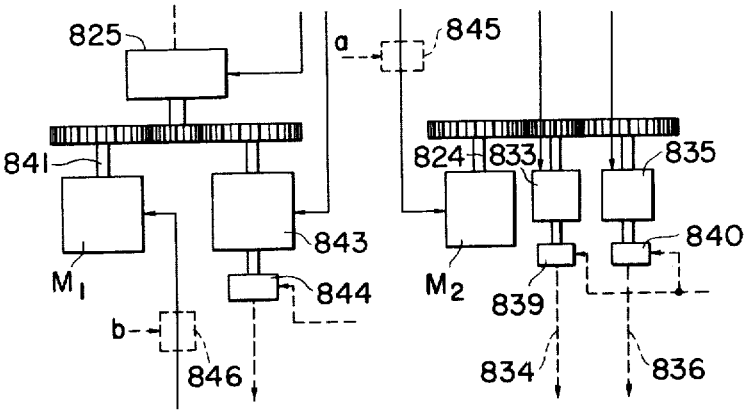
FIG. 26 is a schematic diagram showing a slight modification of the arrangement of FIG. 24.

While rotary switches are used in FIG. 24 to provide the necessary electrical signals in accordance with the respective denominations of coins to be packaged, there may be contemplated, as an alternative, the use of a pushbutton or slide switch mechanism adapted to provide identical electrical signals. It is also possible to use other mechanical, optical, or magnetic means instead of the rotary switch 823 for providing signals representative of the angular position of the shaft 827. Although the second motor $M_2$ is employed for driving the shaft 827 in the configuration of FIG. 24, some other motor of the coin packaging apparatus can of course be used for the same purpose. FIG. 26 illustrates an example of such a modification in which the first motor $M_1$ is adapted to drive the shaft 827 via the electromagnetic clutch 825.

Figure 27:
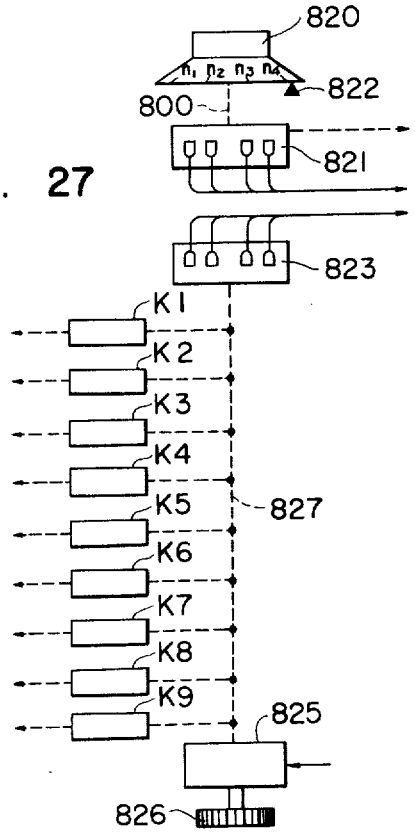
FIG. 27 is also a schematic diagram showing another slight modification of the arrangement of FIG. 24.

Another slight modification of the FIG. 24 configuration is illustrated in FIG. 27, in which all the cam means $K_1$ through $K_9$ are driven by the motor $M_1$ or $M_2$ via the gearing 826, electromagnetic clutch 825 and shaft 827. It will be apparent that the adjustment of the various working components of the apparatus can be effected by these cam means $K_1$ through $K_9$ exactly as previously described in connection with FIGS. 24 and 25.

Figure 28:
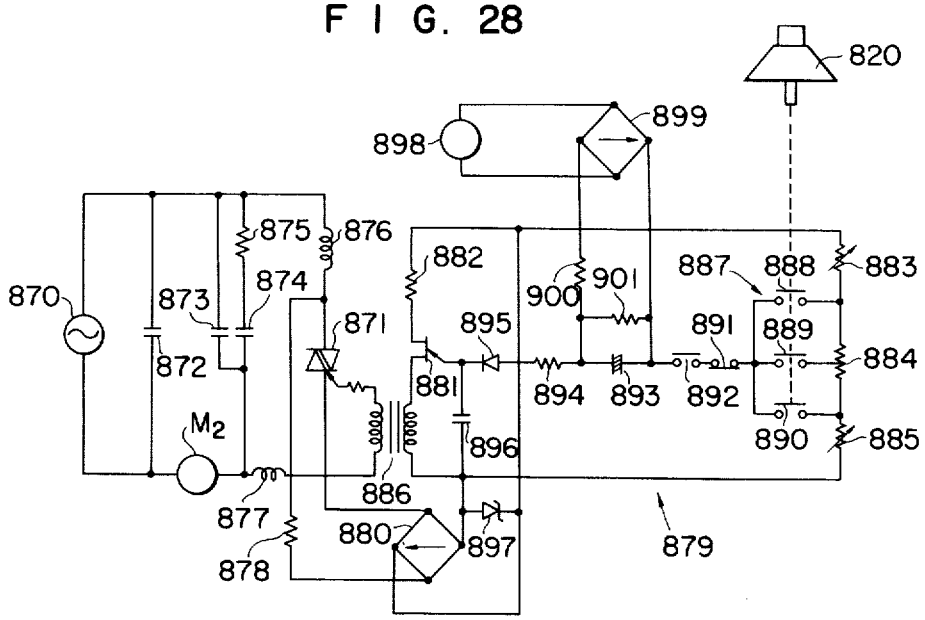
FIG. 28 is a schematic electrical diagram showing control circuitry for the second motor in the apparatus of FIG. 1 which is adapted principally to drive the coin wrapping mechanism.

Instead of the mechanical speed change means shown in FIGS. 24 and 25, electrical circuit means shown in FIG. 28 can be employed for adjustably changing the speed of rotation of the wrapping rolls 20 to 21 in accordance with the diameter of coins to be packaged. In the circuit diagram of FIG. 28 the reference numeral 870 denotes an AC power supply adapted to feed the second motor $M_2$, which in practice may take the form of a capacitor motor. The AC power supply 870 is connected to a bidirectional controlled rectifier 871 as in the drawing. Capacitors 872 to 874, resistance 875, and coils 876 and 877 are provided for the purpose of surge absorption for the bidirectional controlled rectifier 871. The anode and cathode of the bidirectional controlled rectifier 871 are connected to a full wave rectifier circuit 880 which is adapted to function as a power supply for a speed control circuit generally designated by the numeral 879.

Essentially, the speed control circuit 879 is a pulse generator comprising primarily a unijunction transistor 881. Connected across the bases of the unijunction transistor 881 are a resistance 882, variable resistors 883, 884, and 885, and the primary of a pulse transformer 886. The variable resistors 883, 884, and 885 have their respective leads connected to a common point via contact pairs 888, 889, and 890, respectively, of a selector switch 887 to be manually operated by the knob 820. The common point to which are connected the leads of the respective variable resistors 883, 884, and 885 is connected to the emitter of the unijunction transistor 881 via normally closed contact pair 891 which is adapted to be opened by a relay upon completion of coin packaging operation, normally open contact pair 892 which is adapted to be closed by a relay upon completion of the counting of a prescribed number of coins by the counting means 951, FIG. 5, capacitor 893, resistance 894, and diode 895.

A capacitor 896 is connected between the emitter of the unijunction transistor 881 and the pulse transformer 886, and the aforesaid full-wave rectifier circuit 880 is connected between the capacitor 896 and the resistance 882 via an avalanche diode 897. A tachometer generator 898 is coupled to the second motor $M_2$ and is further connected across the capacitor 893 via a second full wave rectifier circuit 899 and resistances 900 and 901.

In the operation of the circuit configuration shown in FIG. 28, it will be understood that the speed of rotation of the second motor $M_2$ depends on which of the contact pairs 888, 889, and 890 of the selector switch 887 is closed by the manual rotation of the knob 820. This is because the frequency of the pulses generated by the speed control circuit 879 changes in accordance with the time constant which is determined by the capacitor 893 and any one of the variable resistors 883, 884, and 885. Thus, in case the rotation speed of the wrapping rolls 20, 21, and 22 must be increased for wrapping a stack of coins of relatively large diameter, for example, the contact pair 888 may be closed. On the other hand, in case the rotation speed of the wrapping rolls must be decreased for wrapping a stack of coins of relatively small diameter, the contact pair 890 may be closed.

When the wrapping rolls 20, 21, and 22 are moved over to their least spaced-apart positions for frictional circumferential contact with the stack of coins supported therebetween, the normally open contact pair 892 of the speed control circuit 879 is closed thereby switching the circuit into operation. Pulses are now generated at a rate depending upon the time constant determined by the capacitor 893 and the variable resistors 883 to 885 through the selective closure of the contact pairs 888 to 890. These pulses are delivered via the pulse transformer 886 to the gate of the bidirectional controlled rectifier 871 thereby causing conduction therethrough in such a manner that the second motor $M_2$ will rotate at a desired speed.

It should be noted that the speed of rotation of the second motor $M_2$ can be held constant regardless any change in load conditions. That is because, upon change in the speed of rotation a the second motor $M_2$ due to some load fluctuation, a corresponding change occurs in the voltage generated by the tachometer generator 898 driven by the motor. Since the voltage generated by the tachometer generator 898 is applied to the capacitor 893 via the full wave rectifier circuit 899, the length of time required for charging the capacitor 893, and therefore the capacitor 896, will change in conformity with the change that has taken place in the voltage developed by the tachometer generator. As a consequence, the frequency of the pulses becomes higher with an increase in the load on the second motor $M_2$, in order to correspondingly increase the speed of motor rotation. Conversely, the pulse frequency becomes lower with a decrease in the load on the motor, in order to correspondingly decrease the speed of motor rotation. The speed of rotation of the second motor $M_2$ can thus be held constant in spite of load fluctuations.

The speed of rotation of the wrapping rolls 20 to 22 can of course be varied for each denomination of coins by the circuit configuration of FIG. 28. However, it is also possible, or indeed practical, that the rotation speed of the wrapping rolls should be varied according to several classes of coins into which the various denominations of coins to be handled by this apparatus have previously been classified according to their diameters. Thus, for instance, coins in the diameter range of, say, from 15 to 20 millimeters may constitute a single class of small diameter coins, coins in the diameter range of from 20 to 25 millimeters another class of intermediate diameter coins, and coins in the diameter range of from 25 to 33 millimeters still another class of large diameter coins. The coin packaging operation of the apparatus will not be substantially impaired by such rough classification of various diameters of coins.

It will be apparent that if the second motor $M_2$ in the circuit configuration of FIG. 28 is replaced by the first motor $M_1$, then the speed of the endless belt 12, rotary disk 13 and endless belt 18 of the infeed mechanism 1 can likewise be controlled in accordance with the diameter of coins to be packaged.

Figure 29:
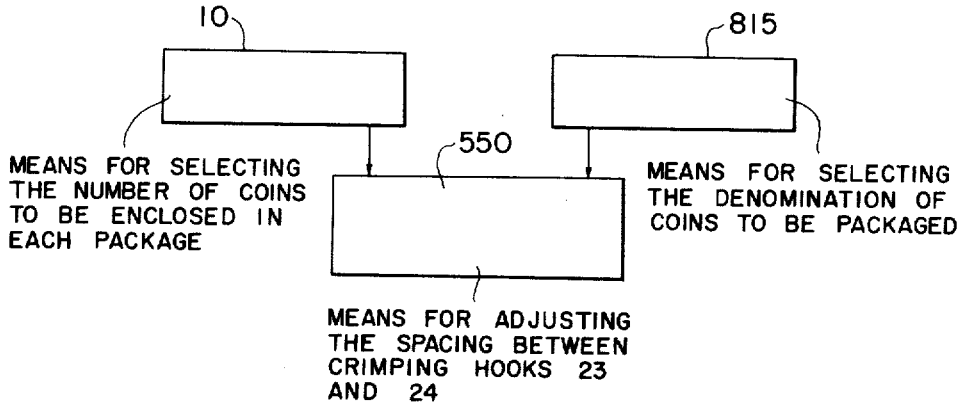
FIG. 29 is a flow chart for explaining the way the spacing between a pair of crimping hooks in the apparatus of FIG. 1 is adjusted in accordance with the denomination and number of coins to be packaged.

Electrical control means for adjusting the spacing between the crimping hooks 23 and 24 in relation to the configuration of FIGS. 24 and 25 is described hereinbelow with reference to FIGS. 29 and 30. As will be apparent from the flow chart of FIG. 29, the operation of the electrical control means 550 is regulated by means 10 for selecting the number of coins to be enclosed in each package and by means 815 for selecting the denomination of coins to be packaged.

Figure 30:
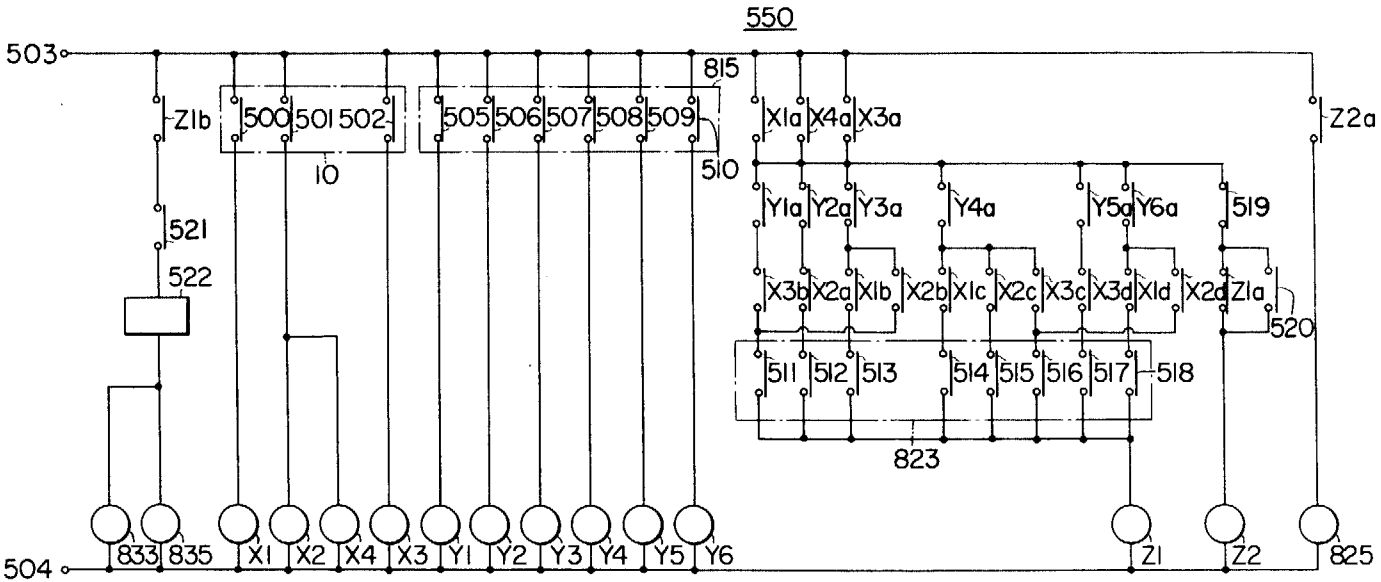
FIG. 30 is a schematic electrical diagram showing control circuitry for adjusting the spacing between the pair of crimping hooks is adjusted in accordance with the denomination and number of coins to be packaged.

As illustrated in detail in FIG. 30, the means 10 comprises a plurality of (three in the illustrated embodiment of the invention) contact pairs 500, 501, and 502 which are connected in parallel with each other across a pair of supply terminals 503 and 504. The contact pairs 500, 501, and 502 are manually actuable via suitable switching means, not shown, to select the number of coins to be enclosed in each package from among three predetermined numbers such as, for example, 20, 40 and 50. The contact pairs 500, 501, and 502 are serially connected to relays $X_1$ to $X_3$, respectively, and another relay $X_4$ is connected in parallel with the relay $X_2$.

The means 815 comprises a plurality of, six in the illustrated embodiment, contact pairs 505 through 510 which also are connected in parallel with each other across the pair of supply terminals 503 and 504. These contact pairs 505 through 510 are likewise manually actuable to select the denomination of coins to be packaged from among six different denominations of coins. The contact pairs 505 through 510 are serially connected to relays $Y_1$ to $Y_6$, respectively.

The normally open contact pairs $X_{1a}$, and $X_{3a}$, and $X_{4a}$ of the respective relays $X_1$, $X_3$ and $X_4$ are connected in parallel relationship to each other to the supply terminal 503. The normally open contact pair $X_{1a}$ is serially connected to the normally open contact pair $Y_{1a}$ of the relay $Y_1$, thence to the normally open contact pair $X_{3b}$ of the relay $X_3$, and thence to the contact pair 511 of the rotary switch 823, FIG. 24, which is operated by the shaft 827. The normally open contact pair $X_{4a}$ is serially connected to the normally open contact pair $Y_{2a}$ of the relay $Y_2$, thence to the normally open contact pair $X_{2a}$ of the relay $X_2$, and thence to the contact pair 512 of the rotary switch 823. The normally open contact pair $X_{3a}$ is serially connected to the normally open contact pair $Y_{3a}$ of the relay $Y_3$, thence to the normally open contact pair $X_{1b}$ of the relay $X_1$, and thence to the contact pair 513 of the rotary switch 513. The respective connections between the normally open contact pairs $X_{1a}$, $X_{4a}$ and $X_{3a}$ and the normally open contact pairs $Y_{1a}$, $Y_{2a}$ and $Y_{3a}$ are interconnected as seen in the drawing. The normally open contact pair $X_{2b}$ of the relay $X_2$ is further connected between the normally open contact pair $Y_{3a}$ and the rotary switch contact pair 511.

The normally open contact pairs $X_{1a}$, $X_{3a}$ and $X_{4a}$ are further serially connected to the normally open contact pair $Y_{4a}$ of the relay $Y_4$, thence to the normally open contact pair $X_{1c}$ of the relay $X_1$, and thence to the contact pair 514 of the rotary switch 823. Connected in parallel with the normally open contact pair $X_{1c}$ and the contact pair 514 are a series circuit consisting of the normally open contact pair $X_{2c}$ of the relay $X_2$ and the contact pair 515 of the rotary switch 823, and another series circuit consisting of the normally open contact pair $X_{3c}$ and the relay $X_3$ and the contact pair 516 of the rotary switch 823.

The normally open contact pairs $X_{1a}$, $X_{3a}$ and $X_{4a}$ are further serially connected to the normally open contact pair $Y_{5a}$ of the relay $Y_5$, thence to the normally open contact pair $X_{3d}$ of the relay $X_3$, and thence to the contact pair 517 of the rotary switch 823. The normally open contact pairs $X_{1a}$, $X_{3a}$ and $X_{4a}$ are further serially connected to the normally open contact pair $Y_{6a}$ of the relay $Y_6$, thence to the normally open contact pair $X_{1d}$ of the relay $X_1$, and thence to the contact pair 518 of the rotary switch 823. The normally open contact pair $X_{2d}$ of the relay $X_2$ is connected between the normally open contact pair $Y_{6a}$ and the contact pair 516 of the rotary switch 823.

All the contact pairs 511 through 518 of the rotary switch 823 are connected to a relay $Z_1$ which in turn is connected to the supply terminal 504.

The normally open contact pairs $X_{1a}$, $X_{3a}$ and $X_{4a}$ are further serially connected to the supply terminal 504 via a switch 519 adapted to be closed upon initiation of operation of the coin packaging apparatus, the normally closed contact pair $Z_{1a}$ of the relay $Z_1$, and a relay $Z_2$. The contact pair for sensing the operative position of the rotary switch 823 is connected in parallel with the normally closed contact pair $Z_{1a}$ of the relay $Z_1$. The normally open contact pair $Z_{2a}$ of the relay $Z_2$ and the electromagnetic clutch 825, previously mentioned with reference to FIG. 24, are serially connected across the pair of supply terminals 503 and 504. Also serially connected across the supply terminals 503 and 504 are the normally open contact pair $Z_{1b}$ of the relay $Z_1$, a starting switch 521, a control circuit 522 adapted to be actuated when the number of coins selected by the means 10 have been counted by the coin counting mechanism 160 shown in FIG. 4, and the electromagnetic clutch 835 adapted to selectively drive the shaft 48 as shown in FIG. 24. The electromagnetic clutch 833 for selectively driving the wrapping rolls 20, 21, and 22 is connected in parallel with the clutch 835.

It will now be assumed that, in the operation of the circuitry shown in FIG. 30, the contact pair 507 of the means 815 and the contact pair 500 of the means 10 are manually closed to cause the apparatus to package 20 coins of the third denomination. The relays $X_1$ and $Y_3$ are both energized, resulting in the closure of the relay contact pairs $X_{1a}$, $X_{1b}$, $X_{1c}$, $X_{1d}$ and $Y_{3a}$. There is now completed a circuit comprising the relay contact pair $X_{1a}$, the switch 519, the relay contact pair $Z_{1a}$, and the relay $Z_2$. As the relay $Z_2$ is thus energized, its contact pair $Z_{2a}$ is closed thereby actuating the electromagnetic clutch 825.

As will be seen by referring back to FIG. 24, the rotation of the shaft 827 is initiated upon actuation of the clutch 825 and continues until the contact pair 513 of the rotary switch 823 is closed. The relay $Z_1$ is then energized to open its normally closed contact pair $Z_{1a}$, with the result that the clutch 825 becomes disconnected to terminate the rotation of the shaft 827 with the contact pair 513 of the rotary switch 823 held closed. The cam means $K_7$ shown in FIG. 25 operates to adjust the spacing between the crimping hooks 23 and 24 so as to be suitable for wrapping a stack of 20 coins of the third denomination.

ALARM MECHANISM

The coin packaging apparatus according to the invention is further equipped with an alarm mechanism as hereinafter described with reference to FIGS. 31 to 42. Troubles to be detected are roughly classifiable between those which may take place prior to the actual operation of the apparatus and those which may take place during the operation of the apparatus. Troubles prior to the operation of the apparatus include Coin Selection Trouble $AL_1$, Resetting Trouble $AL_2$, and Operation Selection Trouble $AL_3$. Troubles during the operation of the apparatus include Motor Overloading Trouble $AL_4$, Coin Feed Trouble $AL_5$, Coin Stacking Trouble $AL_6$, Coin Disarrangement Trouble $AL_7$, and Wrapper Feed Trouble $AL_8$, as diagrammatically represented in FIG. 31.

The coin packaging apparatus cannot be set in operation in the event the listed troubles prior to the operation of the apparatus are detected. The operation of the apparatus is stopped in the event these troubles are detected during its operation. On the other hand, in the event the listed troubles during the operation of the apparatus are detected, the operations of only the mechanism in which the trouble has taken place, and of the mechanisms located immediately before and after the troubled mechanism, are terminated. In either case, the operation is not resumed unless the trouble is eliminated.

1. Coin Selection Trouble

Figure 32:
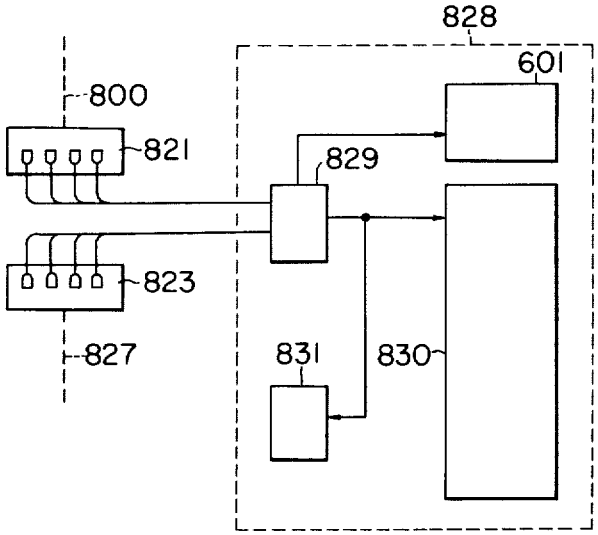
FIG. 32 is a schematic electrical diagram showing means for detecting Coin Selection Trouble according to the alarm mechanism of FIG. 31.

By Coin Selection Trouble is meant the case where the shaft 827 fails to turn to the exact angular position corresponding to the denomination of coins selected by the knob 820, as will be seen from the showing of FIG. 24. In this case, the coincidence detector circuit 829 of the control section 828 is caused to produce an output corresponding to the inversion of the output produced upon agreement of the signals from the rotary switches 821 and 827, as illustrated in FIG. 32. The inverted output from the coincidence detector circuit 829 is delivered to an alarm circuit 601 to trigger the same.

2. Resetting Trouble

Figure 33:
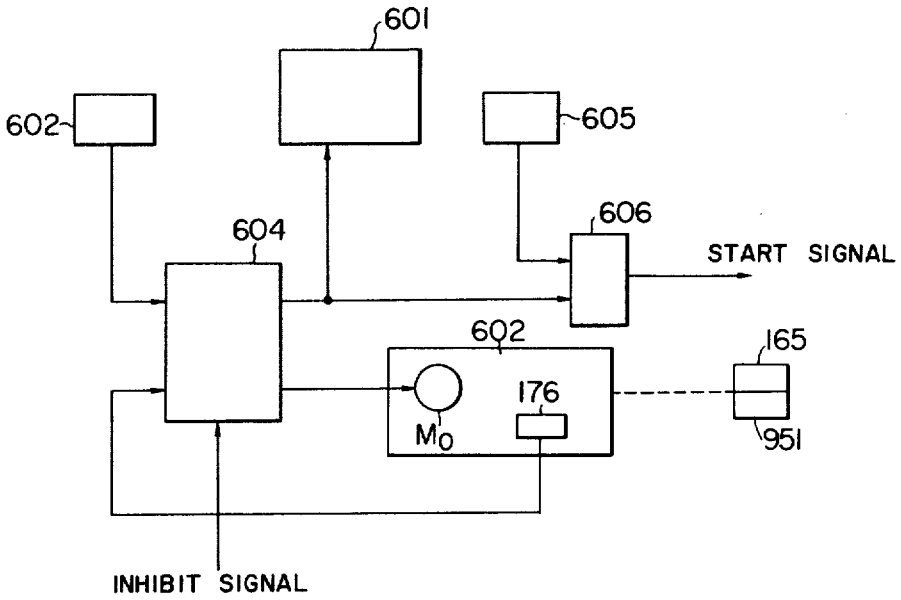
FIG. 33 is also a schematic electrical diagram showing means for detecting Resetting Trouble.

As previously mentioned with reference to FIG. 4, the gear 165 driven by the counting wheel 19 must be turned to the predetermined initial angular position prior to the coin packaging or counting operation of the apparatus, so that the counting means 951, FIG. 5, will be reset to zero. The circuit shown in FIG. 33 is adapted to detect if this resetting operation takes place properly. The reference numeral 604 in FIG. 33 designates a memory section adapted to be set by a signal from a resetting switch 603 included in the control mechanism 8, FIG. 24, and to be reset by a signal from the switch 176, shown also in FIG. 4, constituting a part of the resetting means 602 for the gear 165 and counting means 951. The motor $M_o$ of the resetting means 602 is adapted to be actuated by the set signal from the memory section 604. Thus, if the desired resetting operation is not performed by the resetting means 602 by the signal from the resetting switch 603, the memory section 604 will not be reset by the signal from the switch 176. As a consequence, the memory section 604 will deliver a signal to the alarm circuit 601 to trigger the same and also to an inhibit gate circuit 601 connected to the output of a starting switch 605 included in the control mechanism 8. If then starting switch 605 is actuated to initiate the operation of the apparatus, the output signal from the starting switch is blocked by the inhibit gate circuit 606 to prevent the initiation of operation. It will be noted from FIG. 33 that during operation of the apparatus, an inhibit signal is delivered to the memory section 604 to hold the motor $M_o$ of the resetting means 602 out of operation.

3. Operation Selection Trouble

Figure 34:
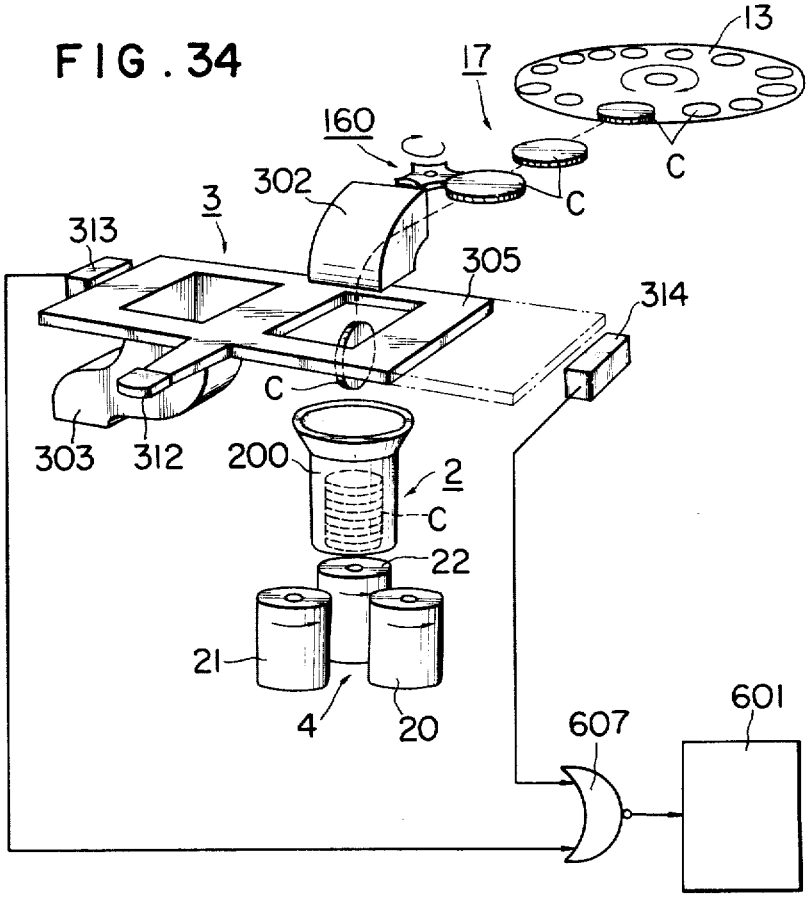
FIG. 34 is a schematic perspective view showing means for detecting Operation Selection Trouble.

As illustrated in FIG. 34, the Opeeation Selection Trouble relates to whether the operation selector member 305 of the operation selector mechanism 6 is positioned properly so as to select the desired one of the coin counting and packaging operations. Thus, in the case where the operation selector member 305 is not positioned in proper abutment against either of the switches 313 and 314, the alarm circuit 601 will be triggered through the following procedure.

The switches 313 and 314 are connected to the respective input terminals of a NOR circuit 607, the output terminal of which is connected to the alarm circuit 601. If the switches 313 and 314 are both held open, therefore, the NOR circuit 607 will deliver its output signal to the alarm circuit 601 to trigger the same, because then the operation selector member 305 is not located in either of its predetermined operative positions.

4. Motor Overloading Trouble

The Motor Overloading Trouble occurs when excess load is exerted on the drive motors of the apparatus from, for example, the rotary disc 13 of the infeed mechanism 1, the endless belt 18 of the coin passageway 17, and the wrapping rolls 20 to 22 of the coin wrapping mechanism 4. The Motor Overloading Trouble should therefore be forestalled to prevent damage to the rotary disc 13 and the guide wall member 180 resulting from the clogging of the coins on the rotary disc, to prevent the frictional wear of the endless belt 18 and the members defining the coin passageway 17, and to prevent damage or deformation of the wrapping rolls 20 to 22 and the crimping hooks 23 and 24. The detection of the Motor Overloading Trouble is also aimed at prevention of possible damage to the coins themselves as they travel through the listed mechanisms.

Figure 35:
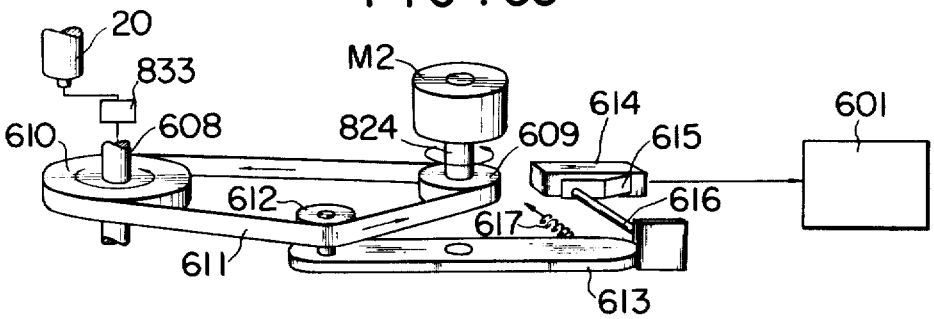
FIG. 35 is a schematic perspective view showing means for detecting Motor Overloading Trouble.

FIG. 35 illustrates an example of means for detecting such Motor Overloading Trouble adapted specifically for the driving system of the coin wrapping mechanism. As endless belt 611 extends around a terminal pulley 609 mounted on the output shaft 824 of the second motor $M_2$ and another terminal pulley 610 mounted on a shaft 608, which shaft is coupled via the clutch 833 to the shaft extending axially outwardly from the wrapping roll 20. The endless belt 611 further extends around a tension pulley 612 rotatably mounted on one end of a lever 613 which is pivotally supported at its intermediate point. The other end of the lever 613 is disposed in abutting relationship to the actuating member 615 of a motor overloading detector switch 614 either directly or via a link 616. The lever 613 is biased by a helical tension spring 617 in such a direction that the tension pulley 612 is yieldably urged against the endless belt 611.

When the endless belt 611 is transmitting the rotation of the second motor $M_2$ to the shaft 68 with a normal degree of tension, the motor overloading detector switch 614 is held closed. However, in the event an excess load is exerted on the shaft 608 as from the wrapping rolls 20 to 22 due to some trouble, the friction between the endless belt 611 and the terminal pulley 610 mounted on the shaft 608 will increase to such an extent that the lever 613 will turn against the force of the spring 617 due to the excessive tension applied to that run of the endless belt 611 which extends over the tension pulley 612. As the motor overloading detector switch 614 is resultantly opened, a signal is delivered therefrom to the alarm circuit 601 to trigger the same. It will be apparent that Motor Overloading Troubles arising in connection with the rotary disc 13, the endless belt 18 and so forth are detectable by identical means.

5. Coin Feed Trouble

Figure 36:
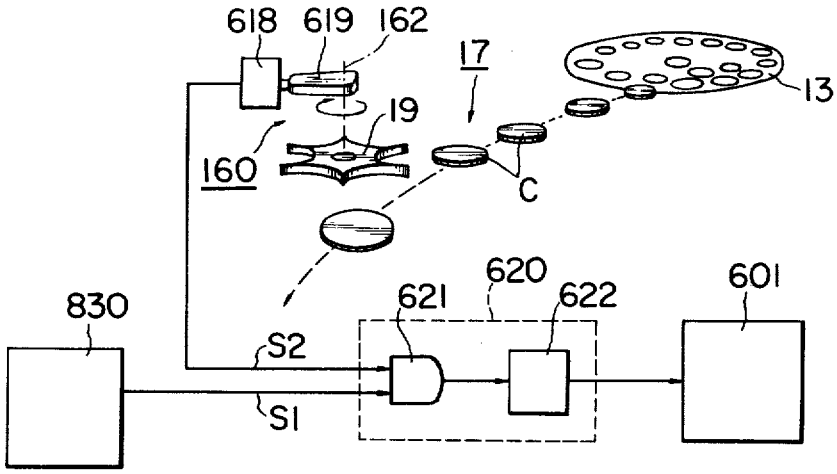
FIG. 36 is a schematic view showing means for detecting Coin Feed Trouble.
Figure 37:
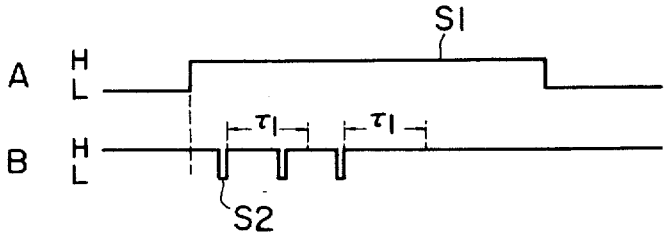
FIGS. 37A and 37B are waveform diagrams for explaining electrical signals used in the detecting means of FIG. 36.

The Coin Feed Trouble occurs when the coins that have been centrifugally sent out into the coin passageway 17 from the rotary disc 13 are not properly fed out of the passageway. As illustrated in FIG. 36, a cam 619 is fixedly mounted on the shaft 162 on which there is also fixedly mounted the toothed counting wheel 19 of the coin counting mechanism 160. This cam is adapted to actuate a counting operation confirmation microswitch 618, in such a manner that the microswitch 618 will produce a counting operation confirmation signal each time the counting wheel 19 completes, say, one complete revolution.

The counting operation confirmation signal $S_2$ from the microswitch 618 is delivered to an AND circuit 621 of a timer circuit 620. Also delivered to the AND circuit 621 is a first motor operation sensing signal $S_1$ from the main control circuit 830, FIG. 24. A time-delay relay 622 also included in the timer circuit 620 is energized by the output from the AND circuit 621. However, as graphically represented at A and B in FIG. 37, the time-delay relay 622 is not energized if the counting operation confirmation signal $S_2$ with its pulse spacing shorter than the delay time $\tau_1$ of the relay 622 is delivered to the timer circuit 620 while the first motor operation sensing signal $S_1$ is being simultaneously supplied. When the pulse spacing of the counting operation confirmation signal $S_2$ becomes longer than the delay time $\tau_1$, the relay 622 is actuated to deliver its output to the alarm circuit 601 to trigger the same.

Figure 38:
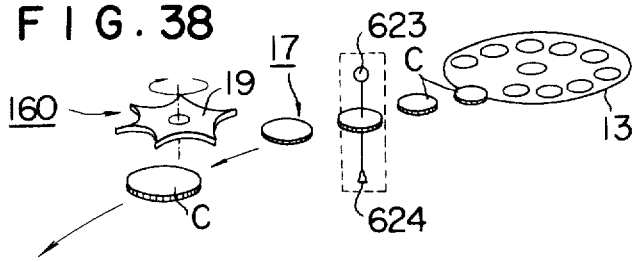
FIG. 38 is a schematic view showing a modification of the detecting means of FIG. 36.

According to the configuration of FIG. 36, the pulses of the counting operation confirmation signal $S_2$ are derived from the microswitch 618 actuated by the cam 619. Alternatively, there may be provided a light source 623 and a photoelectric element 624 adjacent the coin passageway 17, as illustrated in FIG. 38, in such relative positions that an electrical pulse like that shown in FIG. 37B will be produced by each coin C traveling therepast. The counting operation confirmation signal $S_2$ can also be provided by utilizing the "carry" output from the rightmost digit column to the column immediately to the left in the counting means 951 shown in FIG. 5.

It is also possible to obtain the counting operation confirmation signal $S_2$ by utilizing the output from either of the switches 805 and 806 which are actuated by the sensing lever 813 of the sensing mechanism 14 shown in FIG. 3. It will now be assumed that either of the switches 805 and 806 is actuated by an excessive number of coins loaded on the rotary disc 13. If then the delivery of the coins to the coin counting mechanism 160 via the passageway 17 is prevented due to some trouble, the number of coins on the rotary disc 13 will not decrease. Therefore, if either of the switches 805 and 806, actuated as above assumed, does not return to its normal condition within the delay time $\tau_1$ of the relay 622, then it means that the Coin Feed Trouble has taken place.

6. Coin Stacking Trouble

It is likely that some of the coins successively dropped under the force of gravity into the stacking cylinder 200 of the coin stacking mechanism 2 will stand on their edges, instead of properly stacking one upon the other in horizontal disposition. In the event any of a preselected number of coins delivered in a batch into the stacking cylinder 200 stands up on its edge, the height of these coins within the stacking cylinder will exceed a predetermined level. This state is detected by the following means illustrated in FIG. 39. It is to be understood, however, that the stacking cylinder 200 shown in FIG. 39 is not of adjustable inside diameter like that shown previously in FIG. 7 but is to be manually replaced for each different denomination of coins to be stacked.

Figure 39:
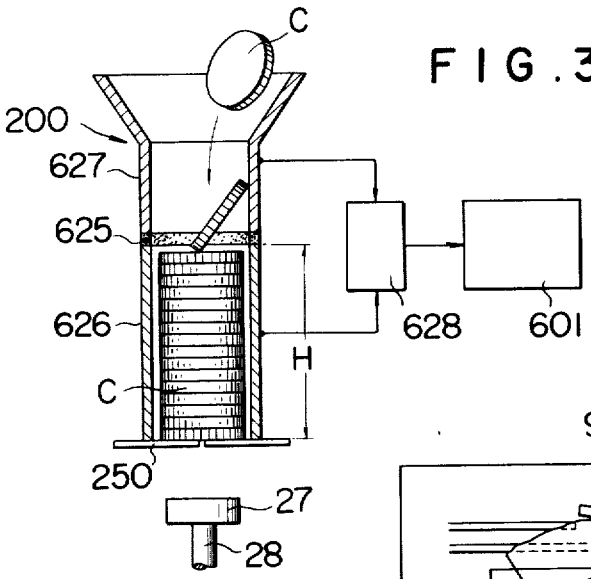
FIG. 39 is a schematic perspective view showing means for detecting Coin Stacking Trouble.

The stacking cylinder 200 shown in FIG. 39 is formed of electrically conducting material completely separated into two portions 626 and 627 which are electrically insulated from each other by a portion 625 located at a height to be reached by the uppermost one of the coins C properly stacked up therein. The coins will be in contact only with the lower portion 626 of the stacking cylinder 200 in the absence of any Coin Stacking Trouble. However, the two conducting portions 626 and 627 will become electrically interconnected when any of the coins stands on its edge as illustrated in the drawing. The conducting portions 626 and 627 are both electrically connected to a detector circuit 628, so that in the event of such Coin Stacking Trouble this detector circuit is actuated to deliver a signal to the alarm circuit 601, thereby triggering the same.

Alternatively, the shutter means 250 openably closing the bottom end of the stacking cylinder 200 may also be formed of electrically conducting material, so as to be electrically connected to the upper cylinder portion 627 in the event of the Coin Stacking Trouble. Instead of the electrical detecting means shown in FIG. 39, optical means may be employed for detecting the presence of any coin above the level of the cylinder portion 625.

7. Coin Disarrangement Trouble

Figure 40:
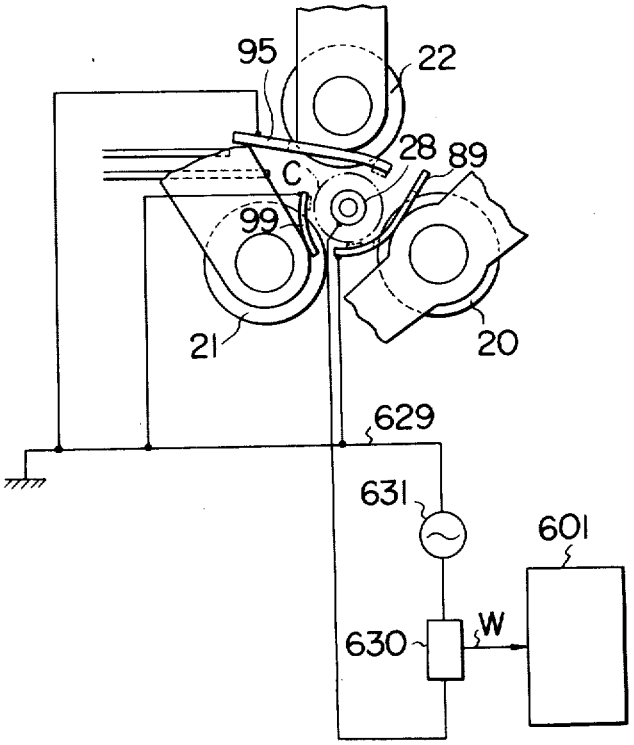
FIG. 40 is a schamatic top plan view showing means for detecting Coin Disarrangement Trouble; p

FIG. 40 illustrates means for detecting the disarrangement or collapsing of coins that have been carried in a stack from the coin stacking mechanism 2 down to the coin wrapping mechanism 4. The wrapping rolls 20 to 22 shown in FIG. 40 are assumed to have at least their entire circumferential surfaces formed of rubber or like electrically insulating material, whereas the wrapper guides 89, 99 and 22 provided for the respective wrapping rolls 20, 21, and 22 are all formed of electrically conducting material and are connected to one of the electrodes of a power supply 631 via a lead 629. Thus, when the wrapping rolls 20, 21, and 22 are moved to their intermediate positions, the Coin Disarrangement Trouble is electrically detected by the wrapper guides 89, 95 and 99.

The guide rod 28, also formed of electrically conducting material, is connected to the other electrode of the power supply 631 via a coin disarrangement detector 630. The coin disarrangement detector 630 may take the form of, for example, an electromagnetic relay. It is also possible, however, that the coin disarrangement detector can be formed of a non-contact relay or of logical circuitry incorporating the power supply 631.

In the configuration shown in FIG. 40, unless there is any Coin Disarrangement Trouble, a stack of coins will be carried down by the guide rod 28 from the coin stacking mechanism 2 guided by the wrapping rolls 20, 21, and 22 of insulating material which are already located in their intermediate positions. It will be apparent that the wrapper guides 89, 95 and 99 can be regarded in combination as one electrode and the guide rod 28 as another electrode. Electrically, the two electrodes are disconnected from each other in the absence of any Coin Disarrangement Trouble, so that no current flows through the coin disarrangement detector 630. The alarm circuit 601 is then not triggered.

However, in event the Coin Disarrangement Trouble takes place, the disarranged coins will fall between the wrapping rolls 20, 21, and 22, inevitably coming into contact with at least one of the wrapper guides 89, 95 and 99. As a consequence, the aforesaid two electrodes become electrically interconnected via the disarranged coins, thereby permitting the flow of current through the coin disarrangement detector 630. An output signal W representative of the Coin Disarrangement Trouble is now produced by the coin disarrangement detector 630.

The output signal W is delivered to the alarm circuit 601 for purposes previously set forth. Since then the operation of the coin wrapping mechanism 4 and of the adjacent mechanism is suspended as above stated, the operator may manually remove the disarranged coins from the coin wrapping mechanism in order to prevent possible damage to the wrapping rolls 20, 21, and 22 and to the neighboring parts. The operation of the coin wrapping mechanism 4 and so forth can immediately be resumed upon removal of the disarranged coins.

Since, according to the configuration of FIG. 40, the wrapper guides 89, 95 and 99 are utilized in combination as one of the electrodes necessary for detection of the Coin Disarrangement Trouble, this electrode can always be located in the optimum position with respect to the stack of coins supported by the guide rod 28 because the wrapper guides are carried by their respective wrapping rolls 20, 21, and 22 to the intermediate positions that are automatically adjusted in accordance with the diameter of the coins to be packaged.

While the wrapper guides 89, 95 and 99 can be formed entirely of electrically conducting material to function as one of the electrodes in the configuration of FIG. 40, it is also possible that these wrapper guides can be formed of electrically insulating material and, instead, portions of conducting material can be arranged vertically on the inside surfaces of those parts of the wrapper guides which extend between the adjacent wrapping rolls 20, 21, and 22, as indicated by the dotted lines in FIG. 40. Connected to the power supply 631, these conducting portions will serve in combination as one of the necessary electrodes for the detection of the Coin Disarrangement Trouble.

Figure 41:
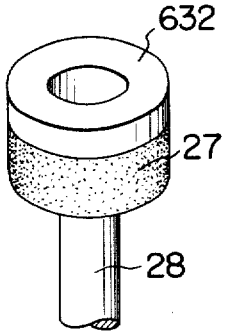
FIG. 41 is a fragmentary perspective view showing a modification of the detecting means of FIG. 40.

FIG. 41 illustrates a slight modification of the configuration of FIG. 40, in which an electrically conducting portion 632 adapted to function as the other electrode for the detection of the Coin Disarrangement Trouble is formed on the flanged top 27 of the guide rod 28. In this manner the guide rod 28 itself can be formed of insulating material, instead of being formed entirely of conducting material as in the configuration of FIG. 40.

8. Wrapper Feed Trouble

The Wrapper Feed Trouble is the failure of the wrapper strip to be fed from the wrapper feed mechanism 7 to the coin wrapping mechanism 4 within a prescribed length of time for wrapping up a stack of coins in the coin wrapping mechanism. This trouble is detected by the following means illustrated in FIG. 42, in which the control section 828 is adapted to produce a timing signal in accordance with the progress of the coin wrapping operation in the coin wraping mechanism 4. This timing signal is delivered to a detecting section 633, which section is adapted to detect whether the wrapper feed signal from the switch 151 (FIG. 21) has been produced within the prescribed length of time following the reception of the timing signal from the control section 828. In the event the wrapper feed signal from the switch 151 is not delivered to the detecting section 633 within the prescribed length of time, the detecting section will produce an output signal to trigger the alarm circuit 601. It will be recalled that the switch 151 is adapted to be actuated when the wrapper strip is properly fed from the wrapper feed mechanism 7 to the coin wrapping mechanism 4.

GENERAL OPERATION

For packaging coins by the apparatus shown in FIG. 1 in particular, the operation selector mechanism 3 is first manupulated to set the apparatus to perform the coin packaging operation. The knob 820 should then be turned to its angular position corresponding to the denomination of the coins to be packaged. Thereupon, as will be seen from FIG. 25, the cams 849, 857 and 852 are turned to their respective corresponding angular positions, thereby adjusting the spacing between the rotary disc 13 and the wall member 15, the width of the coin passageway 17, and the height of the endless belt 18 with respect to the coin passageway 17, in accordance with the diameter or thickness of the selected coins.

A suitable batch of the selected coins is now charged into the hopper 11 as best illustrated in FIG. 1. The coins are then transported by the endless belt 12 onto the rotary disc 13, and as this disc rotates at a suitable speed, the coins will be arranged in a neat row extending circumferentially of the disc. Since the spacing between the rotary disc 13 and the wall member 15 is already adjusted to the thickness of the preselected coin as above stated, any coins overlying others on the disc will be automatically removed from over the underlying coins as the disc rotates and will enter the adjustable width gate 16 at the entrance end of the passageway 17 only one by one.

The width of the gate 16 composed of the stationary guide 184 and movable guide 185, FIG. 2, is also already adjusted to the diameter of the preselected coins because the movable guide 184 moves in step with the movable member 186 defining one of the lateral edges of the passageway 17 as this movable member is shifted as aforesaid by the cam 857 relative to the stationary member defining the other lateral edge of the passageway. The coins are therefore guided smoothly into the passageway 17 via the guide 16 and are transported toward its exit end in frictional contact with the overhead endless belt 18. Coins with a diameter smaller than that of the selected coins, if any, are automatically removed by means, not shown, provided in the passageway 17.

As illustrated in FIG. 4, each coin C fed out of the exit end of the passageway 17 turns the toothed counting wheel 19 of the coin counting mechanism 160 through a prescribed angle. When the number of coins to be enclosed in a single package is counted by the counting mechanism 160, the rotation of the counting wheel 19 is prevented by the detent 175 received in either of the diametrically opposed apertures 167 in the gear 165, so that no more coins are permitted to leave the exit end of the passageway 17.

The coins fed out of the exit end of the passageway as above explained are directed through the chute 306 of the operation selector mechanism 3, FIG. 6, and are caused by gravity to drop into the stacking cylinder 200 of the coin stacking mechanism 2, FIG. 7. As vibrations are imparted to the stacking cylinder 200 by the unshown means, the coins are automatically rearranged therein and are neatly stacked up one upon the other in horizontal disposition.

As the plate members $250_a$ and $250_b$ of the shutter means 250, FIG. 1, are simultaneously moved away from each other to open the bottom end of the stacking cylinder 200, the stack of coins rests on the flanged top 27 of the guide rod 28, FIGS. 10 and 23, and is thereby carried down to the central position between the wrapping rolls 20, 21, and 22 of the coin wrapping mechanism 4, FIG. 10. As previously described in connection with FIG. 25, the revolving speed of the wrapping rolls 20, 21, and 22 is adjusted in accordance with the diameter of the coins via the speed change means 839 by the cams 863, 864, and 865 mounted on the rotatable shaft 827. Furthermore, as the cam 137 mounted on the shaft 139, FIG. 10, rotates through a prescribed angle, the cam 127 is vertically displaced along the shaft 48 by the arm 141, so that the arm 144 is correspondingly moved either toward or away from the other arm 145 to adjust the spacing between the crimping hooks 23 and 24 to the total height of the stack of coins to be wrapped.

Further with reference to FIG. 10, the cam 40 mounted on the shaft 38 is caused to turn through a prescribed angle by the knob 820 via the intermeshing gears 37 and 28. However, as will be seen also from FIG. 11, the cam follower roll 55 on the arm 41 will abut the tongue 53 of the cam 50 which tongue is adapted to cause the wrapping rolls 20, 21, and 22 to be located in their most spaced-apart positions with respect to each other. The cam follower roll 54 on the lever 45 is then urged by the helical tension spring 47 into abutment with the arcuate edge 52 of the cam 49 which edge is adapted to cause the wrapping rolls to be located in their intermediate positions, but the cam follower roll 46 on the other end of the lever 45 is held out of contact with the cam 40.

In the condition set forth in the preceding paragraph, the wrapping rolls 20, 21, and 22 are located in their most spaced-apart positions, and all the wrapper guides in their inoperative positions. The wrapper guides 94 and 95, carried by the arms 58 and 59 and by the arm 81 and 82 respectively, are located in the same positions as the wrapping rolls 20 and 22 respectively. The wrapper guide 89 is directed inwardly as long as the roll 114 on the arm 111 is held out of contact with the sector gear 91 since this sector gear is biased by the helical tension spring 92 as shown in FIG. 10. The wrapper guide 99 is directed outwardly as long as the arms 70 and 71 are located in their most outward position since the sector gear 104 is fixedly supported. The wrapper guide 107, coupled to the arms 70 and 71, is also held in its inoperative position.

With the turn of shaft 48, however, the cam follower roll 55 on the arm 41 leaves the tongue 53 of the cam 50 while the cam follower roll 54 on the lever 45 rides on the arcuate edge 52 of the cam 49. The lever 45 is then further urged by the spring 47 until its cam follower roll 46 abuts the circumference of the cam 40 at its prescribed point, thereby causing the arm 41 to turn an angle determined by the angle of swing of the lever 45. The arm 42 and the sector gear 43 fixedly mounted on the shaft 38 are likewise caused to rotate through the corresponding angle by the constant load spring 67. This rotation of the arm 42 about the shaft 38 results in the rotation of the shaft 68 through the corresponding angle via the link 66 and the arm 69, so that the pair of arms 70 and 71 fixedly mounted on this shaft 68 are caused to turn correspondingly thereby carrying the wrapping roll 21 a step closer to the central axis between the annularly arranged wrapping rolls 20, 21, and 22.

Simultaneously, since the sector gear 104 is immovably supported as above stated, the turn of the arms 70 and 71 results in the rotation of the gear 97 via the gear 103 in such a direction that the wrapper guide 99 moves toward the central axis between the wrapping rolls 20, 21, and 22. The plate member 106 supported by the shaft 105 extending through the pair of arms 70 and 71 is also turned, so that the wrapper guide 107 fixedly supported on one of the lateral edges of the plate member 106 moves toward the central axis between the wrapping rolls 20 to 22.

The rotation of the shaft 38 is further transmitted via the intermeshing sector gears 43 and 57 to the shaft 56, with the result that the wrapping roll 20 is caused to move a step closer to the central axis between the wrapping rolls 20, 21, and 22 by the pair of arms 58 and 59 secured to the shaft 56. The wrapper guide 94 turns with the arms 58 and 59, and the wrapper guide 89 also turns with the arms 58 and 59 toward the central axis between the wrapping rolls without the influenence of the sector gear 91 and the gear 87 since the shaft 62 is retained at one of the extremities of the arcuate slot 93 in the sector gear.

Furthermore, the rotation of the shaft 56 is conveyed to the shaft 79 via the arm 60, the link 78 and the arm 80, so that the pair of arms 81 and 82 secured to this shaft 79 causes the wrapping roll 22 also to move a step closer to the central axis between the wrapping rolls. The wrapper guide 95 carried by the arms 81 and 82 moves in the same direction with the wrapping roll 22.

It is to be noted that the distances the wrapping rolls 20, 21, and 22 are thus caused to move toward the central axis therebetween are determined by the working angular position of the cam 40 against the stepped circumference of which the cam follower roll 46 on the lever 45 is urged as previously described. When all the wrapping rolls 20, 21, and 22 and wrapper guides 89, 94, 95, 99 and 107 are thus moved a step closer to their respective intermediate positions determined in accordance with the diameter of the coins to be packaged, the guide rod 28 rises to a position immediately below the bottom of the stacking cylinder 200 by passing along the central axis between the wrapping rolls.

When the plate members $250_a$ and $250_b$ of the shutter means 250, FIG. 1, are simultaneously moved away from each other by the drive mechanism 9 via the linkage system 251, the coins of the selected denomination which have been arranged into a neat stack within the stacking cylinder 200 are deposited by gravity onto the guide rod 28, which is then caused to descend to carry the stack of coins down to the central position between the wrapping rolls 20, 21, and 22.

Since the shaft 48 is in constant rotation, the cam follower roll 54 on the lever 45 rises on the arcuate edge 51 of the cam 49, which edge is adapted to cause the wrapping rolls 20, 21, and 22 to be located in their least spaced-apart positions, when the stack of coins is brought down to the central position between the wrapping rolls in the above described manner. The wrapping rolls 20, 21, and 22 are then caused to move further toward the central axis therebetween through the above described procedure until they come into circumferential contact with the stack of coins. The wrapper guides 89, 94, 95, 99 and 107 are also caused to move toward the stack of coins supported between the wrapping rolls. It should be noted, however, that the movements of the wrapper guides to their operative position are also regulated in accordance with the diameter of the coins to be packaged. Thus, when the coins are of relatively large diameter, an approximate circle will be defined by all the wrapper guides 89, 94, 95, 99 and 107 in their operative positions as illustrated in FIG. 12, and when the coins are of relatively small diameter, an approximate cicle will be defined only by the wrapper guides 89, 95 and 99 in their operative positions.

When the stack of coins is properly supported in frictional circumferential contact with the wrapping rolls 20, 21, and 22, the second motor $M_2$ is set in rotation at a speed adjusted in accordance with the diameter of the coins to be packaged. This rotation of the motor $M_2$ is imparted to the wrapping roll 20 via the gear 61 and pinion 65 and also to the wrapping roll 21 via the gear train 72, 77 and 75. The stack of coins is thus caused frictionally to rotate in circumferential contact with all of the wrapping rolls 20, 21, and 22.

With reference to both FIGS. 16 and 21, the strip of wrapper fed from its roll 5 by the feed rolls 730 and 731 or by the rolls 127 and 128 already has its leading end caught between the drive roll 31 and idler roll 32 of the wrapper tensioning means 126 due to the preceding coin packaging operation. As the rotation of the second motor $M_2$ is imparted to the wrapping rolls 20 to 21 as above described, the solenoid 125 becomes energized to cause the idler roll 32 to swing into frictional circumferential contact with the drive roll 31 via the arms 121 and 122. The wrapper strip is then frictionally fed forwardly, and due to the tension thus exerted on the wrapper strip, the wrapper sensing plate 145 is pressed against the force of the spring 150 thereby actuating the switch 151, so that the rotation of the shaft 48 continues to permit the progress of the coin packaging operation. When tensioned by the wrapper tensioning means 126, the wrapper strip is cut into a suitable length by the cutter blade 133 or 733. The piece of wrapper thus severed from the rest of the continuous strip then has its leading end caught between the rotating stack of coins and one of the wrapping rolls 20 to 22 and is successively wound around the circumference of the coin stack as its rotation continues.

Upon completion of the winding of the wrapper piece around the circumference of the stack of coins, the cam follower roll 113 on the T-shaped arm 111 rides on the circumferential edge portion 110 of the wrapper guide control cam 108 from its circumferential edge portion 109, the edge portion 110 being adapted to cause the wrapper guides 89 and 107 to be located in their inoperative positions. By the resulting turn of the T-shaped arm 111 about the shaft 82, the roll 114 also mounted on the arm 111 causes the sector gear 91 to turn against the force of the helical tension spring 92. As a consequence, the gear 87 meshing with the sector gear 91 causes the wrapper guide 89 to turn away from the stack of coins C, as indicated by the dot-and-dash lines in FIG. 12.

The turn of the T-shaped arm 111 about the shaft 82 is also conveyed via the links 115, 117 and 118 to the plate member 106, thereby causing the plate member to turn about the shaft 105 in such a direction that the wrapper guide 107 carried thereby shifts away from the stack of coins C, also also as indicated by the dot-and-dash lines in FIG. 12.

With the wrapper piece thus wound around the circumference of the stack of coins, and with the wrapper guides 89 and 107 shifted to their inoperative or "open" positions, the cam follower pin 132 projecting from the movable member 131 drops into the recess on the circumference of the cam 126 fixedly mounted on the constantly rotating shaft 48 under the influence of the tension spring 133. By the resulting turn of the movable member 131 about the shaft 129, the pair of arms 144 and 145 are simultaneously caused to turn about the same shaft 129 thereby carrying the crimping hooks 23 and 24 between the wrapping rolls 20 to 22. Since the cam follower rolls 149 and 150 mounted on the respective arms 144 and 145 abut the top and bottom edges 135 and 134 of the respective cams 135 and 134, and since the arms 144 and 145 are biased toward each other by the constant load spring 148, the crimping hooks 23 and 24 are caused to operate to fold and crimp the loose lateral edges of the wrapper piece, which is already wound around the circumference of the stack of the coins as aforesaid, inwardly over the top and bottom ends, respectively, of the coin stack as its rotation continues.

As the packaging of the stack of coins is thus completed, the cams 127 and 128 still rotate with the shaft 48 to cause the arms 144 and 145, and therefore the crimping hooks 23 and 24, to move away from each other. Thereafter, the cam follower pin 132 mounted on the movable member 131 again comes into abutment with the cam 126, with the result that the movable member 131 turns about the shaft 129 against the force of the tension spring 133 to cause the crimping hooks 23 and 24 to return to their initial inoperative positions.

The cams 49 and 50 further rotate with the shaft 48 until the cam follower roll 54 on the lever 45 again rides on the arcuate edge 52 of the cam 49 while the cam follower roll 55 on the arm 41 rides on the tongue 53 of the cam 50. As a consequence, the wrapping rolls 20 to 22 are caused to move back to their most spaced-apart positions through the above described procedure, so that the packaged stack of coins is released and allowed to drop by gravity into a chute therebelow for discharge from the apparatus. The rotation of the shaft 48 still continues until the cam follower roll 55 on the arm 41 rides completely on the tongue 53 of the cam 50, whereupon the wrapping rolls 20 to 22, the wrapper guides 89, 94, 95, 99 and 107, and the crimping hooks 23 and 24 are all caused to return to their initial inoperative positions. The rotation of the second motor $M_2$ also terminates pending the start of the next cycle of the coin packaging operation.

The invention described and illustrated is believed to admit of many modifications within the ability of those skilled in the art, all such modifications being considered within the spirit and scope of the invention.

What is claimed is:

1. In a coin packaging apparatus for packaging a preselected number of coins of the same denomination in the form of a neat stack, the apparatus having a rotary disc adapted to receive a batch of coins to be packaged and to send out outward said received coins by utilization of centrifugal force of the disc, a wall member provided at the peripheral part of said rotary disc the height of which above the disc is adapted to be regulated in accordance with the thickness of coins, a coin passageway extending from said rotary disc at said wall member so that the coins on said rotary disc are thereby centrifugally sent out one by one into said coin passageway, at least one wall composing said passageway being adjustably spaced from the other wall of said passageway, conveyor means provided above said passageway and adapted for conveying the coins passed under said wall member and thence sent into said passageway; coin counting means provided intermediate the length of said passageway and provided with means adapted to block passage of coins when a preselected number of coins has passed through said passageway, a coin take-out passage provided adjacent the end of said coin passageway for taking out the counted coins, therefrom, a coin guiding passage provided adjacent the end of said coin passageway for guiding the coins to a position adapted for stacking the coins, a change-over mechanism on which said coin guiding passage and said coin takeout passage are mounted and comprising a change-over member movable between a coin stacking mode position and a coin counting mode position, the coin take out passage being aligned with the end of said coin passageway when said changeover mechanism is in the coin counting mode position and said coin guiding passage being aligned with the end of said coin passageway when said changeover mechanism is in the coin stacking mode position, coin stacking means disposed so as to be communicated with said coin guiding passage when said coin passageway is communicated with the coin guiding passage when said change-over member is in the coin stacking mode position and adapted for aligning in a stack the preselected number of coins counted by said counting means, coin wrapping means including at least three wrapping rolls and roll transferring means for transferring at least one of said rolls toward or away from the coin stack, said wrapping rolls being adapted to approach around the coin stack after the stack of coins stacked at said coin stacking part is introduced between said rolls and then to wrap a wrapper sheet around the coin stack while rotating said coin stack, a coin stack guiding mechanism provided with a guide lever adapted to guide the coin stack into the space surrounded by the wrapping rolls, wrapper sheet feeding means for feeding a piece of the wrapper sheet conformed to the size of the coin stack toward the peripheral surface of said coin stack and rotated in the coin wrapping position, and fold-crimping means comprising a pair of crimping hooks adapted to fold-crimp and lateral edges of said sheet of wrapper over the opposite ends, respectively of the coin stack after said sheet of wrapper has been wound around said coin stack; the improvement comprising, in combination, first cam means operatively associated with said wall member for setting the vertical position of said wall member, second cam means operatively associated with the movable wall of said coin passageway for setting the position of said adjustably movable wall to set the width of said passageway so as to correspond to the width of the coins to be stacked, at least one first adjustable shaft means for adjusting the apparatus to operate in the counting mode and coupled to said first and second cam means for actuating said cam means to set the positions of said wall member and adjust the width of the coin passageway in accordance with the coins being handled, cylinder diameter selecting means coupled to said coin stacking means for selecting the inside diameter of the stacking space in said coin stacking means, third cam means operatively associated with the movable roll of said wrapping rolls for moving the movable roll to a position corresponding to the diameter of coins in a stack and for guiding the coin stack into the coin wrapping position, fourth cam means operatively associated with said fold-crimping means for setting the fold crimping means to a position corresponding to the denomination of the stack of coins to be wrapped, setting means adapted operatively associted with said wrapper sheet feeding part for driving said feeding part for feeding a wrapper sheet corresponding to the denomination of the coins of the coin stack to be wrapped, second adjustable shaft means for adjusting the apparatus to operate in the wrapping mode and coupled to said cylinder diameter selecting means, said third cam means, said fourth cam means, and said setting means for setting said wrapper sheet feeding part, coin denomination selecting means, and control means coupled between said denomination selecting means and said adjustable shaft means for driving only said first adjustable shaft means when the apparatus is in the counting mode and for driving both said first and second adjustable shaft means when the apparatus is in the wrapping mode.

2. The improvement as claimed in claim 1 in which said apparatus has at least one electrical source of rotary power adapted to drive said coin counting means and said coin wrapping means said control means comprising:

first electrical means coupled to said coin denomination selecting means for producing an output representative of the denomination of coins selected by said coin denomination selecting means;

first electrically actuable clutch means through which said electrical source of rotary power is coupled to at least one of said adjustable shaft means;

second electrical means coupled to said adjustable shaft means for producing an output representative of the angular position of said rotatable shaft;

coincidence detector circuit means to which said first and second electrical means are coupled to deliver the outputs thereof, said coincidence detector circuit means being coupled to said clutch means and producing an output upon agreement of said outputs from said first and second electrical means to disconnect said first clutch means;

second electrically actuable clutch means coupled to said electrical source of rotary power and to which said coincidence detector circuit means coupled for driving said coin counting means and said coin wrapping means when actuated by said output from said coincidence detector circuit means.

3. The improvement as claimed in claim 2 in which said first adjustable shaft means is connected to said coin denomination selecting means for being manually driven when said coin denomination selecting means is manually driven, and said first electrically actuable clutch means is coupled between said second adjustable shaft means and said electrical source of rotary power.

4. The improvement as claimed in claim 2 in which said control means comprises a second source of rotary power coupled to said first adjustable shaft means, and said coin denomination selecting means is electrically coupled to said second source of rotary power for driving said first adjustable shaft means in response to actuation of said coin denomination selecting means, and said first electrically actuable clutch means is coupled between said second adjustable shaft means and said at least one electrical source of rotary power.

* * * * *